US005166740A

United States Patent [19]

Tanahashi et al.

[11] Patent Number: 5,166,740

[45] Date of Patent: Nov. 24, 1992

[54] RECIRCULATING DOCUMENT HANDLER HAVING AN AUXILIARY PADDLE ROLLER ROTATED AT DIFFERENT SPEEDS

[75] Inventors: Hirohumi Tanahashi, Toyokawa; Toshiyuki Sakai, Shinshiro, both of Japan

[73] Assignee: Minolta Camera Kabushiki Kaisha, Osaka, Japan

[21] Appl. No.: 628,841

[22] Filed: Dec. 11, 1990

[30] Foreign Application Priority Data

Dec. 11, 1989 [JP] Japan ..... 1-321758

[51] Int. Cl.[5] ..... G03G 21/00

[52] U.S. Cl. ..... 355/321; 271/3.1; 271/220; 271/224; 271/314; 355/317

[58] Field of Search ..... 271/3.1, 314, 220, 224, 271/119; 355/309, 317, 321

[56] References Cited

U.S. PATENT DOCUMENTS

| | | | |
|---|---|---|---|
| 4,264,187 | 4/1981 | Rhodes, Jr. | 355/320 |
| 4,313,673 | 2/1982 | Wartinger et al. | 355/308 |
| 4,526,464 | 6/1985 | Milillo | 271/314 |
| 4,537,497 | 8/1985 | Masuda | 355/313 |
| 4,560,158 | 12/1985 | Wilson | 271/3.1 X |
| 4,589,654 | 5/1986 | Kanoto | 271/314 |
| 4,852,867 | 8/1989 | Johdai et al. | 270/53 |
| 4,912,518 | 3/1990 | Matsuo et al. | 355/317 |
| 4,946,153 | 8/1990 | Kinoshita et al. | 270/53 |

*Primary Examiner*—A. T. Grimley
*Assistant Examiner*—Nestor R. Ramirez
*Attorney, Agent, or Firm*—Burns, Doane, Swecker & Mathis

[57] ABSTRACT

A recirculating document handling apparatus for use in a copying machine having an exposure station at which a document to be copied is scanned. The RDH apparatus comprises a document support tray for accommodating a stack of documents to be copied, a recirculating transport mechanism for transporting each of the documents from the document support tray towards the exposure station and then from the exposure station back to the document support tray, and an auxiliary roller provided in the document support tray for feeding each of the documents towards a document feed unit. The auxiliary roller can be selectively operated at two different speeds to assist returning documents to the document feed unit.

6 Claims, 29 Drawing Sheets

| |
|---|
| Fig.38(a) |
| Fig.38(b). |

Position Ctrl
#14
#121
Sensor S11 OFF?
NO
YES
#122
Sensor S10 ON?
NO
YES
#123
Doc. Feed Required?
NO
YES
#124
First Copy ?
NO
YES
#125
Sensor S21 ON?
NO
YES
#126a
Stop Motor 119
#126b
Reverse Motor 119
#127
Sensor S21 ON?
NO
YES
#128
Stop Motor 119
#129
Set Timer T3
To #130
Return
#141
Set Timer T2
#142
Reverse Motor 119
#143
Timer T2 Completed?
NO
YES
To #144
Return
#151
Set Timer T1
#152
Timer T1 Completed?
NO
YES
To #153

#19a

Doc. Rec. Ctrl
#301
Manual Feed Mode?
YES
NO
#302
S23 OFF Edge?
NO
YES
#303
Grouping Mode?
YES
#304
Exposed Required Times ?
NO
NO
YES
#305
Drive Motor 310 at Low Speed
#306
S22 OFF Edge?
NO
YES
#307
Start Timer Drive Motor af High Speed
#308
Timer Completed ?
NO
YES
#309
S10 OFF?
NO
YES
#309a
All Sen-Sors OFF?
NO
YES
#309b
Stop Motor
#310
Drive Motor at Low Speed
Return

#20
Manual Feed ctrl
#191
Manual Feed Mode?
NO
YES
#192
First Copy?
NO
YES
#193
Motor Flag ← 1
#194
Motor Rotation Flag ← 1
#196
Solenoid SL3 ON?
NO
YES
#197
Solenoid SL4 ON
To#198
Return
#221
Copied Desired Nos.?
NO
YES
To#231
To#222

RECIRCULATING DOCUMENT HANDLER HAVING AN AUXILIARY PADDLE ROLLER ROTATED AT DIFFERENT SPEEDS

BACKGROUND OF THE INVENTION

1. Field of the Invention

The present invention generally relates to an automatic document feeding mechanism for use in an image recording machine such as a copying machine or a laser printer and, more particularly, to the automatic document feeding mechanism of a type wherein sheet-like documents to be copied can be automatically transported successively from a document storage unit towards a document reading station and then from the document reading station back to the document storage unit.

2. Description of the Related Art

The U.S. Pat. No. 4,313,673 discloses an automatic document feeding mechanism of the type referred to above. This prior art automatic document feeding mechanism is so designed and so operable that the lowermost one of sheet-like documents to be copied which are stacked on a document support tray can be drawn outwardly from the document support tray for the transportation thereof towards a document reading station at which an image on the lowermost document can be scanned, and, after the image on the lowermost document has been scanned at the document reading station, it can be returned to the document support tray so as to lie atop the stack of the remaining sheet-like documents.

During the successive circulation of the sheet-like documents from the document support tray back to the document support tray past the document reading station, it is often experienced that, if the next succeeding, or second-fed, document is transported from the document reading station to the document support tray before the first-fed document is returned to the document support tray with its trailing ends completely received within the document support tray, the second-fed document may squeeze into between the documents supported on the document support tray and the trailing end of the first-fed document, resulting in a possible problem that subsequent copies would be made out of order. On the other hand, if a sufficient length of time is provided between the timing of complete return of the first-fed document into the document support tray and the start of feed of the second-fed document towards the document reading station, the number of copies afforded by the image recording machine for each unit time will be reduced.

Also, even though the length of time between the timing of complete return of the first-fed document into the document support tray and the start of feed of the second-fed document is chosen to be of a value effective to avoid the above discussed inconvenience, it may often occur that, during the return of the first-fed document into the document support tray, the first-fed document may be transported in a skewed fashion and/or in a relationship generally jammed with the previous document and, therefore, the second-fed document may be squeezed in beneath the first-fed document.

SUMMARY OF THE INVENTION

Accordingly, the present invention is intended to provide an improved automatic document feeding mechanism of circulatory type, wherein an auxiliary roller effective to substantially eliminate the above discussed problems and inconveniences is provided in front of the document support tray with respect to the direction of transport of each documents from the document support tray back to the document support tray past the document reading station.

Another important object of the present invention is to provide an improved automatic document feeding mechanism of the type referred to above, wherein a difference is provided between the speed of transport of each document along a platen and the speed of discharge of the document after having been scanned or exposed, thereby to substantially eliminate the above described problems and inconveniences.

BRIEF DESCRIPTION OF THE DRAWINGS

These and other objects and features of the present invention will become clear from the following description of preferred embodiments of the present invention with reference to the accompanying drawings, in which:

FIG. 1(*b*) is a side sectional view, on an enlarged scale, of an essential portion of the copying machine shown in FIG. 1(*a*);

DETAILED DESCRIPTION OF THE EMBODIMENT

While a first preferred embodiment of the present invention will be described hereinafter, the present invention will be described as applied to an electrophotographic copying machine capable of making double-sided copies and equipped with an automatic recirculating document handler (RDH) operable to feed documents automatically successively under any one of various copying modes towards a document reading station.

Figure 1A:
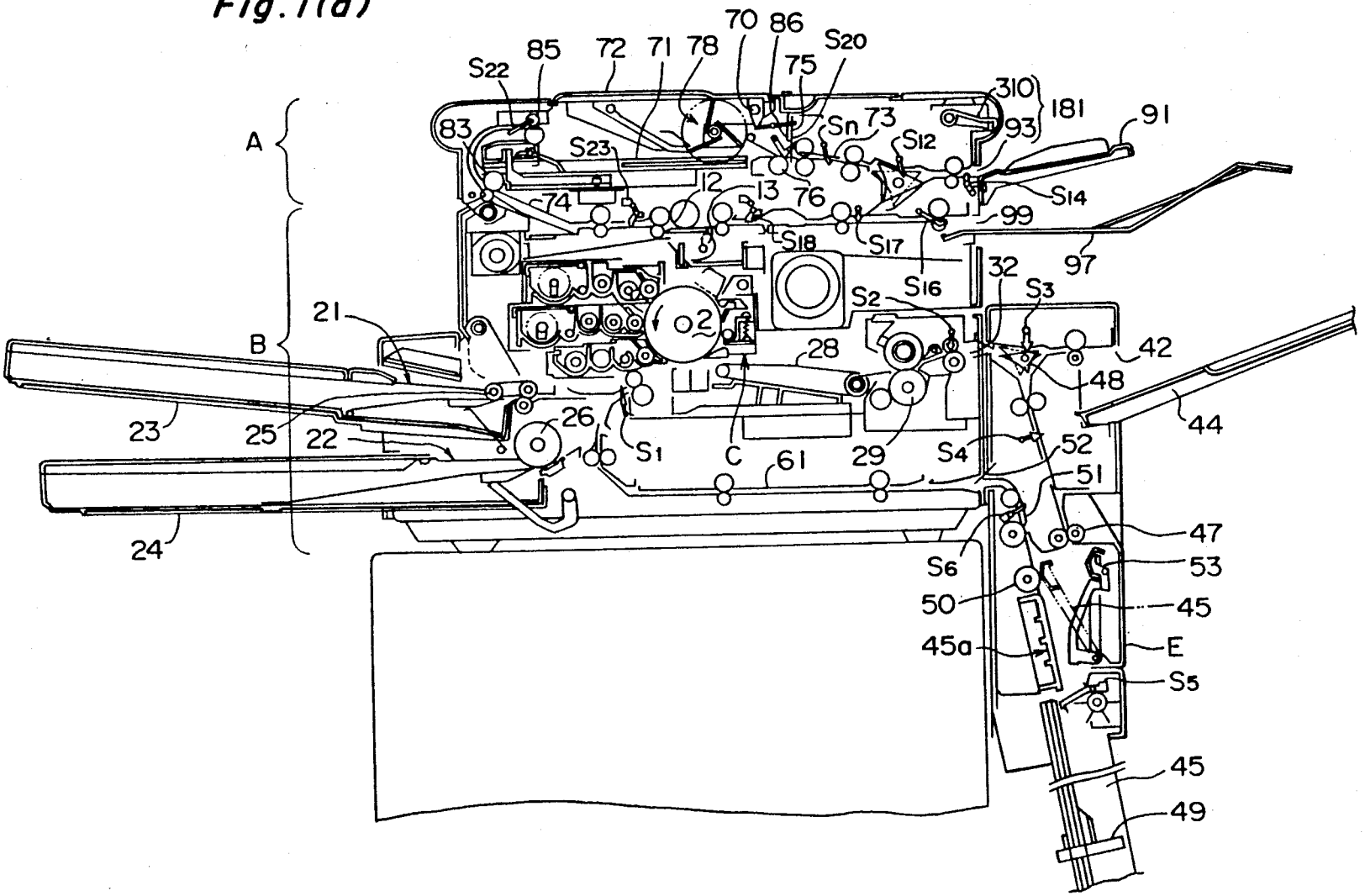
FIG. 1(*a*) is a side sectional view of an electrophotographic copying machine according to a first preferred embodiment of the present invention.
Figure 1B:
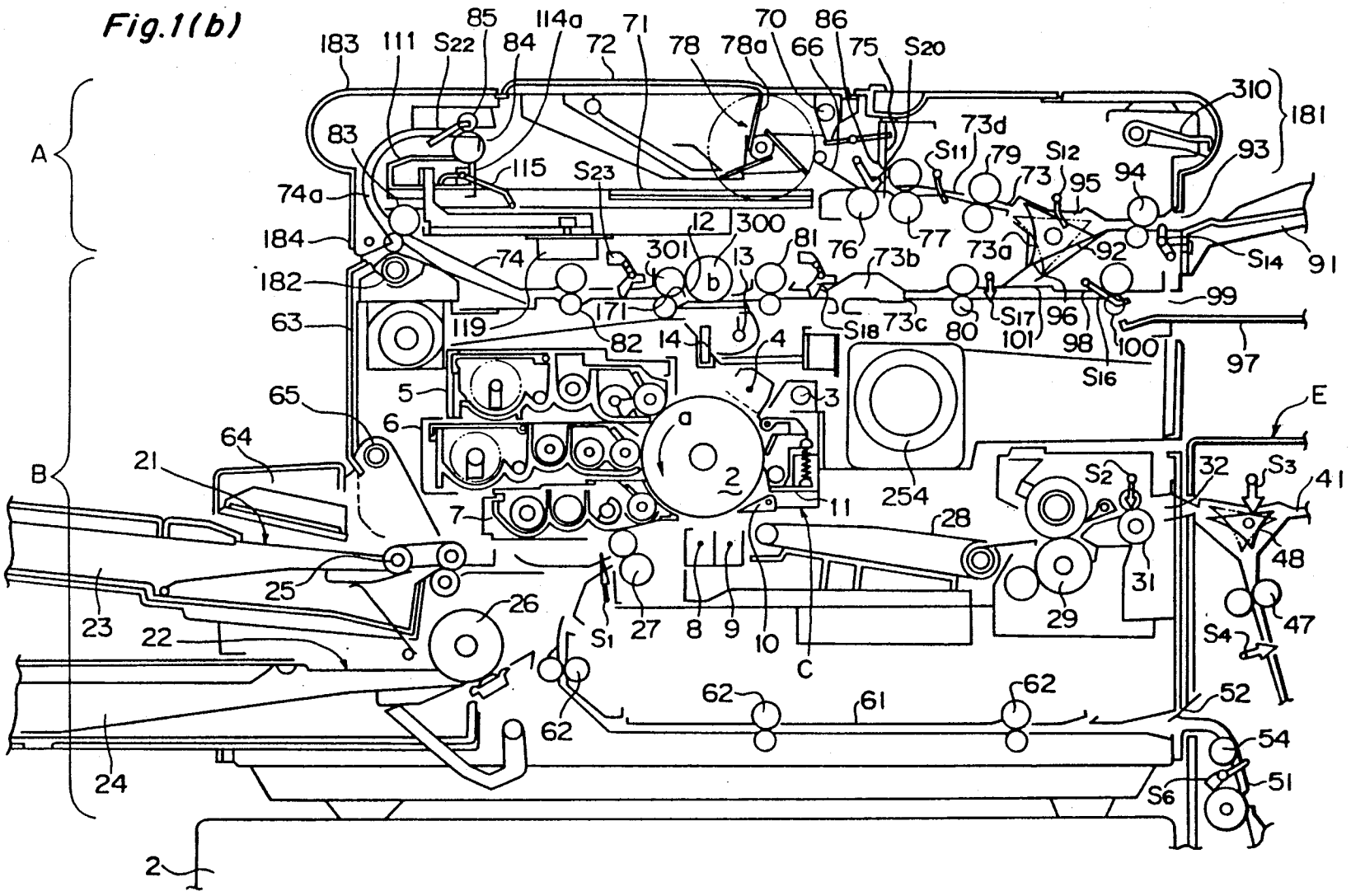

Referring to FIGS. 1(*a*) and 1(*b*), the copying machine shown therein is mounted on a bench or any other suitable base structure and comprises a RDH block A and a copier block B positioned below the RDH block A.

The copier block B has an image forming workshop which has a photoreceptor drum 2 supported within a machine housing for rotation in one direction shown by the arrow a sequentially past a plurality of processing stations during each complete rotation thereof. Those processing stations include an erasing station at which an eraser lamp 3 is disposed; a charging station at which an electrostatic charger 4 disposed; a developing station at which upper, intermediate and lower developing units 5, 6 and 7 accommodating respective masses of toner material of different colors are disposed; a transfer station at which an electrostatic charger 8 is disposed; a separating station at which a separator charger 9 and a separating pawl 10 are disposed; and a cleaning station at which a cleaning unit 11 is disposed. An exposure workshop D is defined above the image forming workshop C and has a glass platen 12 positioned fixedly atop the copier block B, an illuminator lamp 13 positioned fixedly beneath the glass platen 12 for illuminating a document to be copied, and a fixedly supported lens array 14 in the form of optical fibers in a bundled configuration for guiding imagewise rays of light from the document towards the photoreceptor drum 2.

The copying machine so far shown and described is of a type wherein during an image scanning the document is transported above the glass platen 12 in a direction shown by the arrow b relative to the illuminator lamp 13 and the imagewise rays of light reflected from the document and bearing an image of the document can be projected onto a uniformly electrostatically charged surface of the photoreceptor drum 2 through any known slit-exposure system to form an electrostatic latent image on the electrostatically charged surface of the photoreceptor drum 2.

The photoreceptor drum 2 having the electrostatic latent image formed on the photosensitive surface thereof is subsequently moved past the developing station at which one of the developing units 5 to 7 is selectively brought into operation to develop the electrostatic latent image into a visible powder image in a color associated with the selected developing unit. The visible powder image on the photoreceptor drum 2 is then transferred by the action of the transfer charger 8 at the transfer station onto a recording paper which has been fed thereto in synchronism with the arrival of the visible powder image at the transfer station. Thereafter, the recording paper onto which the visible powder image has been transferred from the photoreceptor drum 2 is separated by the action of the separator charger 9 and the separator pawl 10 from the photoreceptor drum and is subsequently conveyed towards a fixing station. After the separation of the recording paper from the photoreceptor drum 2, the latter during the continued rotation thereof is moved past the cleaning station at which residue toner material is cleaned off from the photosensitive surface of the photoreceptor drum, followed by a removal of residue electrostatic charge by the action of the eraser lamp 3. Then, in readiness for the next succeeding cycle of electrostatic copying, the photosensitive surface of the photoreceptor drum 2 is uniformly electrostatically charged by the electrostatic charger 4.

At a bottom left portion of the copier block B as viewed in FIGS. 1(*a*) and 1(*b*), the copying machine comprises two paper supply units 21 and 22 positioned one above the other for removably receiving respective sheet cassettes 23 and 24 accommodating respective stacks of recording sheets of different sizes. Each of the paper supply units 21 and 22 has a feed roller assembly 25 or 26 operable to feed the recording paper one by one from the associated sheet cassette 23 or 24 towards the transfer station immediately beneath the photoreceptor drum 2. The feed roller assemblies 25 and 26 can be selectively brought into operation in response to the application of a paper select signal thereto in a manner well known to those skilled in the art.

Each recording paper drawn out from the associated sheet cassette 23 or 24 by the action of a corresponding one of the feed roller assemblies 25 and 26 which is then brought into operation in response to the paper select signal is, before it reaches the transfer station, transported to a registration roller pair 27 by which not only is the recording paper retained for a length of time required for it to arrive at the transfer station in synchronism with the arrival of the visible powder image carried by the photoreceptor drum 2, but also it can be rectified if skewed relative to the direction of transport thereof towards the transfer station. The recording paper onto which the visible powder image has been transferred and which has subsequently been separated from the photoreceptor drum 2 is conveyed by means of a suction conveyor 28 towards the fixing station at which a fixing unit 29 is disposed for fixing the powder image permanently on the recording paper to provide a one-sided copy. The copy so formed is subsequently ejected by the action of an ejector roller pair 31 through a discharge mouth 32 defined in a right-hand end wall of the machine housing.

In the vicinity of the discharge mouth 32, an intermediate tray assembly E can be detachably fitted to the machine housing for re-supply of the one-sided copy so that a double-sided copy can be eventually obtained as will be described later.

The intermediate tray assembly E is of an upright design and includes a discharge passage 41 defined therein in communication with the discharge mouth 32. A portion 42 of the discharge passage 41 adjacent a discharge mouth 42 that is defined in the wall of the intermediate tray assembly E in opposition to the discharge mouth 32 is provided with an ejector roller pair 43 for ejecting the recording paper, which has been passed through the fixing station, onto a copy collecting tray 44 supported immediately below the discharge mouth 42 of the intermediate tray assembly E. A portion of the discharge passage 41 between the discharge mouth 32 and the ejector roller pair 43 is communicated with a delivery passage 46 extending generally downwardly therefrom towards an intermediate stack 45 through a delivery roller pair 46. A switching pawl 48 is disposed in the junction between the discharge passage 41 and the delivery passage 46 for pivotal movement between discharge and delivery positions so that the recording paper emerging outwardly from the discharge mouth 32 can be selectively fed towards the discharge mouth 42 or towards the intermediate stack 45 through the delivery passage 46 depending on the position of the switching pawl 48.

The intermediate stack 45 includes a sheet receptacle 49 adjustably movable up and down depending on the size of the recording paper introduced into the intermediate stack 45 through the delivery passage 46 so that an upper edge of any one of the recording papers introduced into the intermediate stack 45 can be aligned at all times with a position slightly above the position of a paper feedback roller 50 which is supported in an upper region of the intermediate stack 45.

The intermediate stack 45 is communicated not only with the generally downwardly extending delivery passage 46, but also with a feedback passage 51 through which the recording paper can be fed in a switchback fashion, said feedback passage 51 leading to and being communicated with a receiving mouth 52 which is defined in the end wall of the machine housing in the copier block B. The intermediate stack 45 has a sheet guide surface 45*a* aligned straight with the feedback passage 51 and slightly inclined with its upper end leaning towards the receiving mouth 52, said sheet guide surface 45*a* being operable to support the recording paper which has been introduced into the intermediate stack 45 through the delivery passage 46. The feedback roller 50 referred to above is positioned generally immediately above the inclined sheet guide surface 45*a* and is cooperable with a pinching arm 53 supported for pivotal movement between retracted and pinching positions. This pinching arm 53, when moved to the pinching position as shown by the phantom line in FIG, 1(*a*), urges the upper edge of any one of the recording papers in the intermediate stack 45 against the feedback roller 50 to frictionally hold the upper edge of each recording paper therebetween to facilitate the feed of the respective recording paper during the drive of the feedback roller 50 towards the receiving mouth 52 through a delivery roller 54. This pinching arm 53 is normally moved to the retracted position as shown by the solid line in FIG. 1(*a*), clearing from the delivery passage 46 and can be moved to the pinching position only when any one of the recording papers fed into the intermediate stack 45 is desired to be fed backwardly towards the receiving mouth 52 and then into a circulating passage 61 in the copier block B.

In the copier block B, the paper circulating passage 61 extends from the receiving mouth 52 to the registration roller pair 27 for circulating the recording paper, fed from the intermediate stack 45 in the switchback fashion, towards the transfer station past the registration roller pair 27 so that another visible power image can be transferred onto the recording paper in a manner similar to that effected on any one of recording papers supplied from one of the paper supply units 21 and 22, thereby to provide a duplexed copy having its opposite surfaces bearing respective reproduced images. To facialitate a smooth transport of the recording paper along the circulating passage 61, the circulating passage 61 has a plurality of, for example, three delivery roller pairs 62.

The copier block B is constitituted by lower and upper frame assemblies 64 and 63 which are hingedly coupled with each other through a hinge shaft 65, positioned above and in the vicinity of the paper supply units 21 and 22, for pivotal movement about the hinge shaft 65 between a closed position, as shown in FIGS. 1(*a*) and 1(*b*), and an opened position. A parting line between the upper and lower frame assemblies 63 and 64 extends through the hinge shaft 65 and immediately above a paper feed passage, extending from any one of the paper supply units 21 and 22 to the suction conveyor 28, and also immediately above the fixing unit 29 and the ejector roller pair 31 so that, when the upper frame assembly 63 is angularly moved to the opened position relative to the lower frame assembly 64, an operator of the machine can be accessible to the interior of the machine for the purpose of, for example, inspection of machine component parts and/or removal of jammed papers.

The RDH (recirculating document handler) block A includes a document support tray 71 positioned somewhat leftwards of a top region of FIG. 1. This document support tray 71 is provided with a lid 72 supported by a shaft 70 for pivotal movement between opened and closed positions. A right-hand, front end of the document support tray 71 is in continuation with a generally U-shaped feed passage 73 extending therefrom towards a position immediately above the glass platen 12 and including a U-shaped path 73*a*. The feed passage 73 is also communicated with a return passage 74 extending the position above the glass platen 12 to a position above a left-hand, rear end of the document support tray 71 through a generally U-shaped path 74*a*.

A junction between the document support tray 71 and the feed passage 73 is provided with a stopper 75 supported for movement between elevated and lowered positions in a direction generally perpendicular to the path of travel of any one of the documnts to be copied, said stopper 75 being operable to hold a stack of documents in the document support tray 71 at a predetermined position. Positioned in front of the stopper 75 with respect to the direction of feed of the respective document along the feed passage 73 is a delivery roller 76 operable to draw the documents in the document support tray 71 successively outwardly from the documents support tray 71 one by one in the order from the lowermost one of the stack of the documents in the document support tray 71. Positioned on one side of the stopper 75 opposite to the delivery roller 76 is a pair of shuffling rollers 77 operable to shuffle the document to ensure that only the lowermost document in the stack of the documents in the document support tray 71 can be further fed along the feed passage 73.

Figure 12:
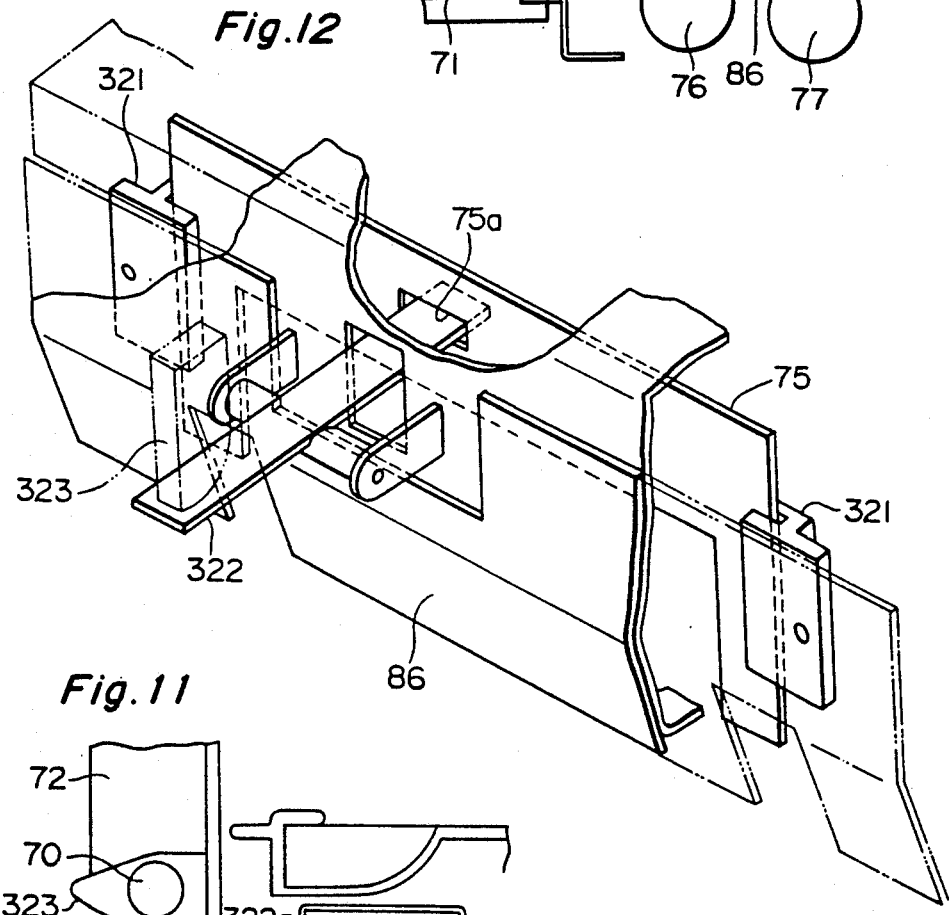
FIG. 12 is a perspective view of the document stopper.

The stopper 75 is drivingly associated with the movement of the lid 72 between the opened and closed positions by means of a mechanical linkage (or in any suitable manner using, for example, an electric linkage). More specifically, as shown in FIGS. 9 to 12, the stopper 75 being generally rectangular in shape has its opposite ends guided along respective guide members 321 for movement between the elevated and lowered positions and is normally biased downwards so as to assume the lowered position by the effect of its own weight or by the action of any suitable biasing spring so that the stack of the documents in the document support tray 71 can be halted at the predetermined position. The shaft 70 bearing the lid 72 has a cam member 323 fixedly mounted thereon for movement together with the lid 72, said cam member 323 being held in frictional contact with one end of a pivot lever 322 which is pivotally supported at a substantially intermediate portion thereof by a pivot pin 322*a*, the opposite end of said pivotal lever 322 being engaged into a perforation 75*a* that is defined in a top center portion of the generally rectangular stopper 75 as best shown in FIG. 12.

Figure 9:
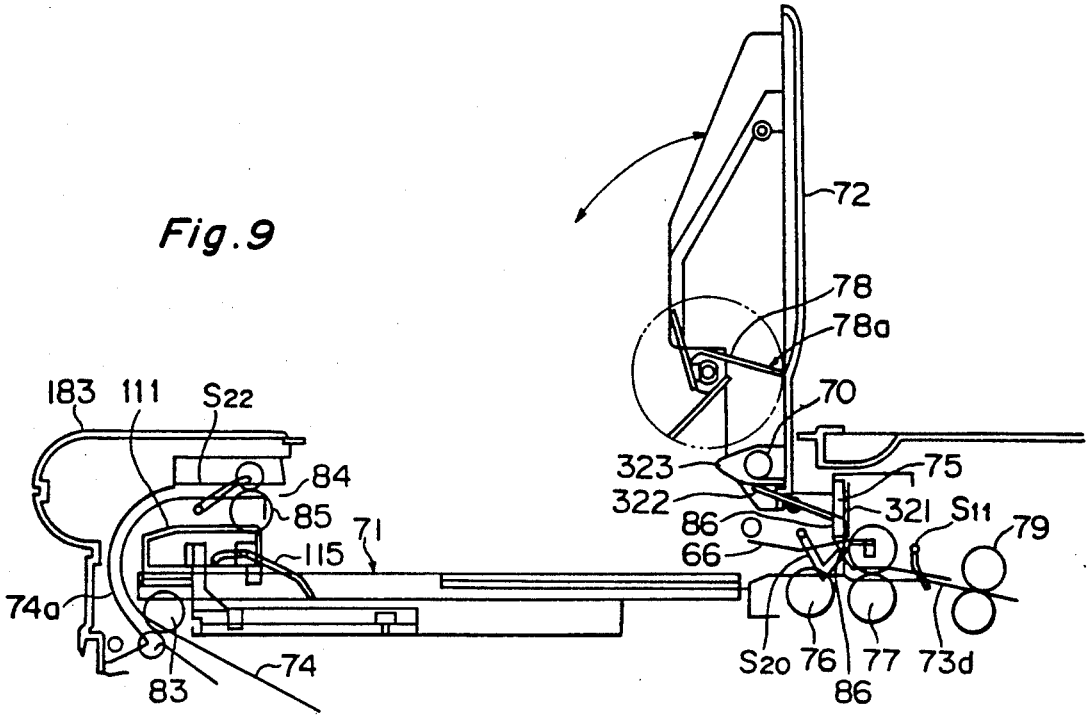
FIG. 9 is a sectional view of a document support tray employed in the copying machine.
Figure 10:
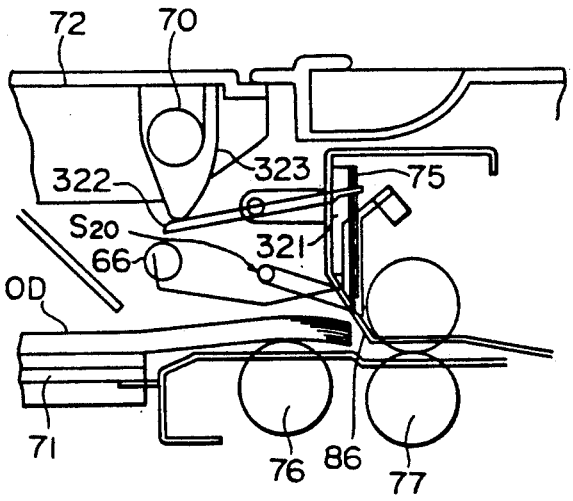
FIGS. 10 and 11 are sectional view showing a document stopper at different operative positions, respectively.
Figure 11:
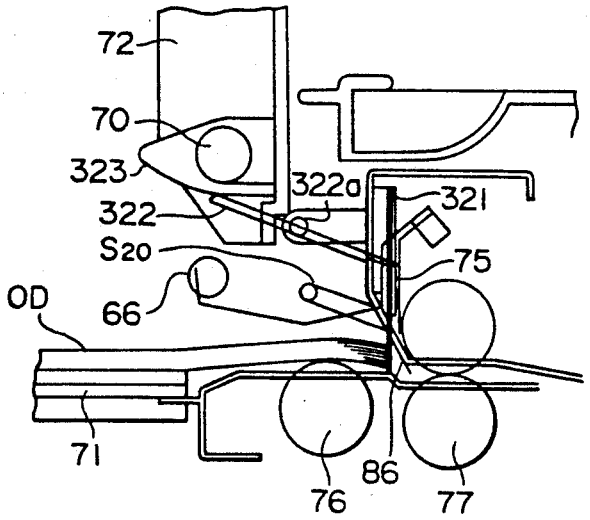

In this arrangement, when the lid 72 is pivoted from the closed position, as shown in FIG. 10, towards the opened position as shown in any one of FIGS. 9 and 11, the cam member 323 movable together with the lid 72 allows the pivot lever 322 to pivot clockwise about the pivot pin 322*a* as viewed in FIG. 11, with the weight of the stopper 75 acting on the other end of the pivot lever 322, accompanied by a free downward movement of the stopper 75 from the elevated position, as shown in FIG. 10, towards the lowered position as shown in FIG. 11 thereby to retain the stack of the documents OD in the document support tray 71 at that predetermined position. Since the stack of documents OD to be copied is placed within the document support tray 71 from above while the lid 72 is held at the opened position, the documents manually placed within the document support tray 71 can be easily set in position and aligned end-to-end due to the stopper 75 then held at the lowered position.

On the other hand, when the lid 72 is moved from the opened position towards the closed position, the cam member 323 depresses the adjacent end of the pivot lever 322 downwards and, therefore, the pivot lever 322 is pivoted counterclockwise with the other end of said pivot lever 322 consequently lifting the stopper 75 upwards from the lowered position towards the elevated position, thereby releasing the ends of the stack of the documents OD as shown in FIG. 11 in readiness for the documents OD to be successively fed out from the document support tray 71.

Figure 15:
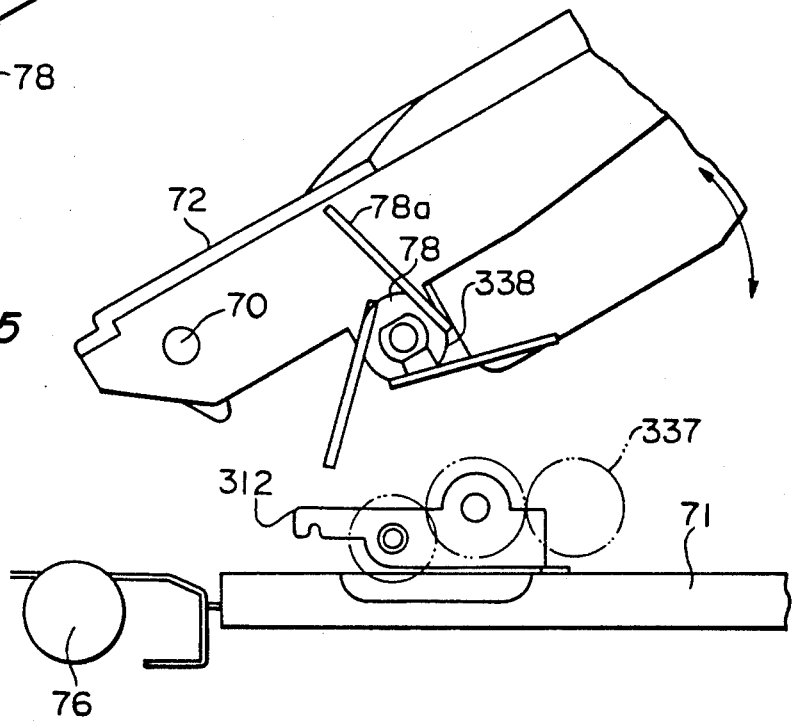
FIG. 15 is a sectional view showing the auxiliary roller and the lid in a linked position.

Referring to FIGS. 1 and 13 to 15, an auxilliary roller assembly 78 having a plurality of generally radially outwardly extending flexible paddles 78*a* is positioned immediately above the front end of the document support tray 71 and is carried by the lid 72. Because the auxiliary roller asssembly 78 is carried by the lid 72, the auxillary roller assembly 78 is retracted upwardly away from the document support tray 71 as shown in FIG. 15 as the lid 72 is pivoted from the closed position towards the opened position about the shaft 70. This upward retraction of the auxiliary roller assembly 78 opens an access space leading to the document support tray 71 to facilitate the placement of a stack of the documents OD within the document support tray 71 without providing any obstructions.

On the other hand, when the lid 72 in the opened position is moved to the closed position about the shaft 70, the auxiliary roller assembly 78 is lowered close towards the document support tray 71 and held in position at which the auxiliary roller assembly 78 is operable to feed the document OD, which has been circulated along the circulating passage 74 and subsequently returned into the document support tray 71 through a delivery roller pair 85, until it can base brought into abutment with a preparatory shuffling plate 86 while such document OD is pressed from above by the flexible paddles 78*a*.

It will be experienced that, when a second-fed document OD is discharged from the document support tray 71 before the first-fed document OD returned into the document support tray 71 through the delivery roller pair 85 at the adjacent end of the circulating passage 74 is completely received within the document support tray 71, the second-fed document OD will squeeze into between the first-fed document OD and the uppermost document remaining within the document support tray 71. If, in order to avoid this problem, a sufficient feed interval is provided between the first-fed document and the second-fed document, the number of copies afforded by the copying machine for each unit time will be reduced. In view of this, it is a general practice to employ a minimum allowable feed interval between the successively transported documents OD. However, since the documents OD successively returned through the circulating passage 74 into the document support tray 71 may often be skewed with respect to the direction in which it ought to be transported and/or may often be deviated from the regular feed interval as a result of a light jamming or a deviation in transport speed, it often occurs that the second-fed document may squeeze into between the first-fed document and the uppermost document remaining in the document support tray 71.

Figure 13:
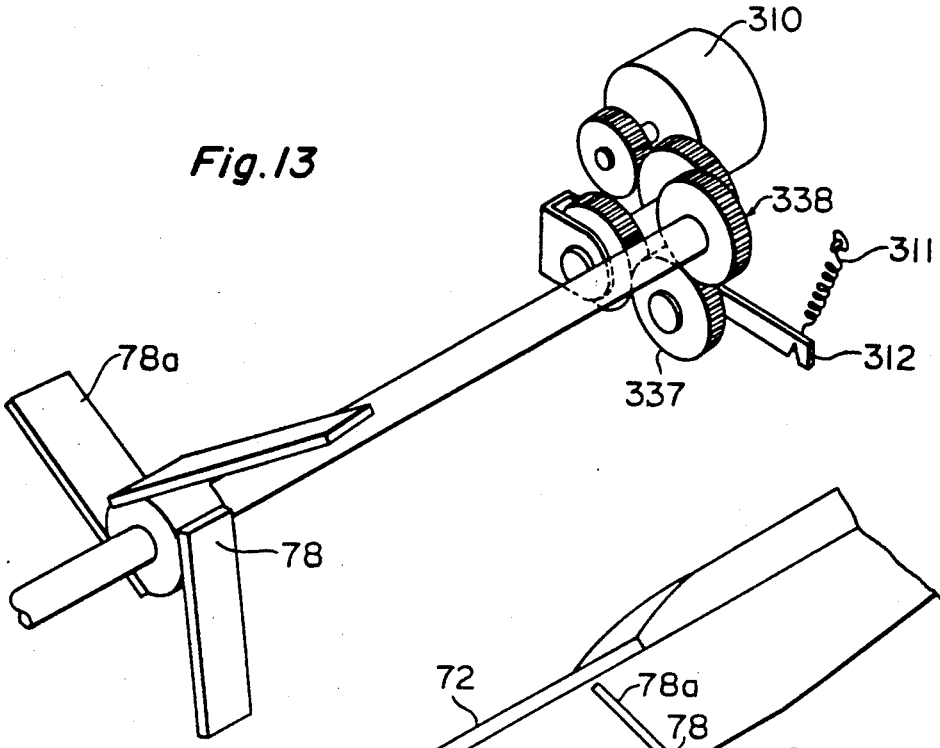
FIG. 13 is a perspective view of an auxiliary roller drive mechanism installed at a portion of the document support tray.
Figure 14:
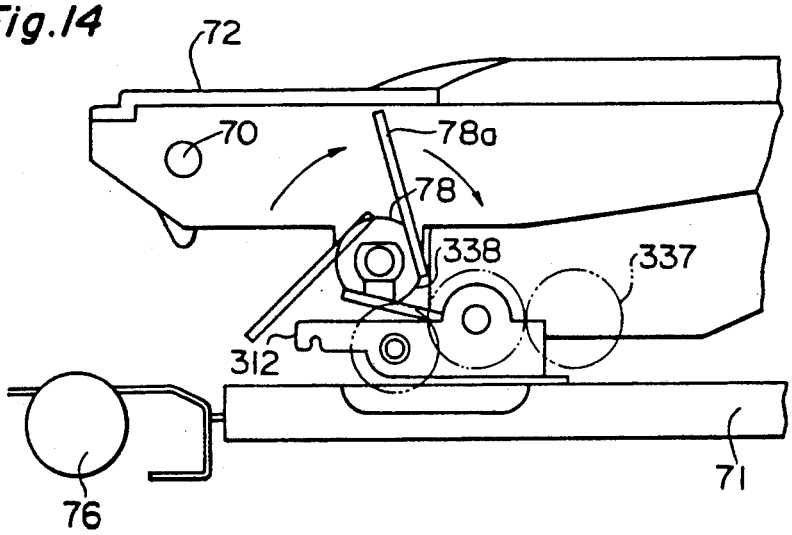
FIG. 14 is a sectional view showing the auxiliary roller and a lid for the document support tray in one operative position.

In order to substantially eliminate the foregoing inconveniences, arrangement has been made that the auxiliary roller assembly 78 can be driven by a drive motor 310 through a drive gear train 337 and a driven gear 338 at one of high and low speeds. It is to be noted that, the transmission of a drive of the drive motor 310 to the auxiliary roller assembly 78 is possible only when and after the lid 72 is moved to the closed position with the driven gear 338 drivingly meshed with the drive gear train 337 as shown in FIGS. 13 and 14. It is also to be noted that the low speed of the drive motor 310 corresponds to a peripheral velocity of a free end of each of the flexible paddles 78*a* of the auxiliary roller assembly 78 which is chosen to be equal to the speed of transport of each document within the recirculating document handler block A, whereas the high speed of the drive motor 310 corresponds to that peripheral velocity higher than the speed of transport of each document within the recirculating document handler block A. Although the auxiliary roller assembly 78 is held still even though the feed of the document OD is initiated, the auxiliary roller assembly 78 can be driven at the low speed after exposure of the first-fed document OD and then at the high speed for a predetermined length of time required for the first-fed document OD to reach the preparatory shuffling plate 86 after the trailing end of the first-fed document OD has left from the delivery roller pair 85. After the passage of said predetermined length of time, the auxiliary roller assembly 78 resumes the low speed. This cycle of change in speed is repeated before each document OD is completely circulated from the document support tray 71 back to the document support tray 71 through the circulating passage 74 in the RDH block A.

With this system, even though the feed interval between the successively fed documents OD is small, the first-fed document OD can be fed to the preparatory shuffling plate 86 at a speed higher than the speed of transport of the second-fed document OD at the time the first-fed document OD has been completely returned into the document support tray 71, thereby to increase the feed interval between the first-fed and second-fed documents OD. Therefore, even though the feed interval between the successively fed documents OD varies by some reason, it does not occur that the feed interval between them is reduced to a value smaller than a predetermined value, thereby effectively avoiding the previously discussed problems.

With the copying machine set in a grouping mode, the auxiliary roller assembly 78 is held still during a period in which the document OD is exposed a required number of times. Because of this, the auxiliary roller assembly 78 will not be unnecessarily driven, thereby avoiding generation of noises produced by the flexible paddles 78*a* repeatedly patting the stacked documents within the document support tray 71 and any possibility that a pencilled document may be stained as a result of repeated frictional contact with the flexible paddles 78*a*. After the exposure has been made the required number of times, the auxiliary roller assembly 78 starts its drive at the low speed and is subsequently driven at a high speed for a predetermined time after the trailing end of the document OD has left from the delivery roller pair 85.

It is to be noted that, when the copying machine is set in a manual document feed mode, the auxiliary roller assembly 78 is not used and is therefore not driven.

Delivery roller pairs 79 and 80 are disposed along the feed passage 73 and on respective sides of the U-shaped path 73*a*. A timing roller pair 81 is disposed along the circulating passage 74 at a location preceding the glass platen 12 with respect to the direction of circulation of each document. The timing roller pair 81 is operable to temporarily hold the document, which has been fed thereto through the delivery roller pairs 79 and 80, thereby to rectify the document, if fed in a skewed fashion, with a leading end of such document aligned in a nipping region between timing rollers forming the timing roller pair 81, by causing the document to form a loop. This timing roller pair 81 is also operable to synchronize the passage of the document across the glass platen 12 with the exposure thereof. A portion of the feed passage 73 between the delivery roller pair 80 and the timing roller pair 81 is provided with an escapement 73*b* in which the document OD can form a loop.

A portion of the circulating passage 74 confronting the glass platen 12 is provided with a soft exposure roller 300 for urging the document towards the glass platen 12. The circulating passage 74 has delivery roller pairs 301, 82 and 83 positioned therealong the glass platen 12 and the U-shaped path 74*a*. The delivery roller pair 85 referred to above is disposed adjacent an exit end 84 of the circulating passage 74. Thus, the document having been exposed during its passage across the glass platen 12 can be transported along the circulating passage 74 past the delivery rollers 82 and 83 and is then returned into the document support tray 71 by means of the delivery roller pair 85 disposed adjacent the exit end 84 of the circulating passage 74.

According to the system so far described, the documents OD stacked within the document support tray 71 can be successively drawn one by one into the feed passage 73 and are, after each of the documents OD has been subjected to the exposure at the glass platen 12 while pressed thereagainst by the exposure roller 300, returned through the circulating passage 74 back to the document support tray 71 and onto the uppermost document remaining within the document support tray 71. Where the documents OD within the document support tray 71 are stacked in order of page, the documents OD having been successively returned from the circulating passage 74 into the document support tray 71 are accordingly piled up in order of page. Therefore, when the plural documents within the document support tray 71 are successively and repeatedly transported from the document support tray 71 back to the document support tray 71 past the document reading station defined by the glass platen 12, plural copies can be obtained for each of the documents OD and are piled up on the copy collecting tray 44 in order of page in a so-called sorted fashion.

The preparatory shuffling plate 86, generally rectangular in shape, is disposed diagonally rearwardly of the shuffling roller pair 77 with respect to the direction of transport of each document and is operable not only to block the document which has been returned through the circulating passage 74, but also to shuffle leading ends of the respective documents OD within the document support tray 71 to permit them to be generally diagonally aligned with each other with the leading end of the uppermost document set back relative to the leading end of the lowermost document, thereby to facilitate a shuffling function during the document transportation.

The RDH block A has a manual feed table 91 positioned immediately above the intermediate tray assembly E and protruding rightwardly from the wall of the machine housing as viewed in FIGS. 1(*a*) and 1(*b*). This manual feed table 91 is adapted to feed a sheet-like document to be copied, which is placed thereon, into a manual feed passage 92 continued to an upstream passage portion 73*c* of the feed passage 73 via the U-shaped path 73*a*. A manual feed roller pair 94 for drawing the document, manually placed on the manual feed table 91, into the manual feed passage 92 and then into the upstream passage portion 73c of the feed passage 73 via the U-shaped path 73a for presentation to the exposure. An auxiliary passage 95 is provided in continuation to a downstream portion 73d of the feed passage 73 on one side of the U-shaped path 73a opposite to the upstream passage portion 73c, said auxiliary passage 95 being branched off from a portion of the manual feed passage 92 adjacent the manual feed roller pair 94. This auxiliary passage 95 is used to allow a double-side document OD, supplied from the document support tray 71, to fed towards the manual feed table 91 after the exposure of one side face of such double-sided document OD and then to feed it again towards the document reading station through the manual feed passage 92 for presentation to the exposure of the opposite side face of such double-sided document OD in a switchback fashion. For this purpose, the manual feed roller pair 94 is reversible, that is, can be driven selectively in one of the opposite directions counter to each other. However, in normal use, the manual feed roller pair 94 is driven in a direction required to feed any document OD towards the manual feed table 91, thereby to avoid any possible biting of foreign matter.

A switching pawl 96 is provided at the junction among the manual feed passage 92, the auxiliary passage 95 and the U-shaped path 73a and is selectively pivotable to one of a first position as shown by the solid line in FIG. 1, in which the document OD supplied from the document support tray 71 can be guided towards the U-shaped path 73a, and a second position as shown by the phantom line in FIG. 1 in which the document OD supplied from the document support tray 71 can be guided into the auxiliary passage 95 and also in which the document OD manually placed on the manual feed table 91 can be guided into the manual feed passage 92.

A document discharge passage 98 for the discharge of the manually fed document is branched off from a portion of the feed passage 73 at which the manual feed passage 92 is connected. This document discharge passage 98 is continued to a document receiving tray 97 positioned immediately beneath the manual feed table 91 in an upper region of the RDH block A for receiving the manually fed document. To facilitate the discharge of the manually fed document onto the document receiving tray 97, an ejecting roller pair 100 is provided inwardly adjacent a discharge mouth 99 of the document discharge passage 98.

An upper surface of the glass platen 12, the downstream passage portion 73c of the feed passage 73, the document discharge passage 98 and an upper surface of the document receiving tray 97 are arranged so as to be substantially in flush with each other so that the document OD to be copied can be reciprocated over the glass platen 12 a required number of times for presentation to the exposure by the utilization of them in cooperation with a return passage 74 and the interior of the document support tray 71. For this purpose, the delivery rollers pairs 80, 82, 83, 85 and 301, the timing roller pair 81, a document discharge roller pair 100 and the exposure roller 300 are of a reversible type that can be driven selectively in one of the opposite directions counter to each other.

When a single document OD is continuously presented to a required number of exposures, the resultant recording papers, i.e., copies, are ejected onto and piled up on the copy collecting tray 44 in a fashion forming a group of copies associated with such single document OD and, however, in the case of the plural documents OD, groups of the copies associated respectively with those plural documents are ejected onto and piled up on the copy collecting tray 44 in a grouped fashion.

Thus, the document OD to be copied is reciprocated over the glass platen 12 a required number of time. Therefore, in order to avoid the possibility that the document OD may enter the U-shaped path 73a or the manual feed passage 92 when such document OD is to be transported from the downstream passage portion 73c into the document discharge passage 98, an elastic resin sheet piece 101 is fitted to a corner area defined between the manual feed passage 92 and the discharge passage 98 so as to extend towards and contact an upper guide portion on the feed passage 73.

Although the document receiving tray 97 is open to accommodate any size of the document when for the purpose of a grouped copying the document OD is reciprocated over the glass platen 12, the shuffling roller pair 77 on the side of the document support tray 71 would impose a limitation to the large-size document which is manually fed through the manual feed table 91. In view of this, the dimension from the exposure station, that is, the document reading station, to the shuffling roller pair 77 through the return passage 74 is selected to cope with the maximum possible size of any document to be copied.

Positioned rearwardly of the document support tray 71 is a positioning member 111 operable to regulate the position of the document OD which is returned in the form as initially set in the document support tray 71, the details of said positioning member 111 being best shown in FIGS. 2 to 8. As shown therein, the positioning member 111 includes a base plate 113 supported for movement to and fro along a window 112 defined in a bottom plate 71a of the document support tray 71, and a cover 114 mounted on the base plate 113 with its front end defining a position regulating face 114a. A central portion of the base plate 113 covered by the cover 114 is formed with a window 113a that is aligned with the window 112 in the bottom plate 71a of the document support tray 71 and is also formed with passive projections 113b and 113c protruding upwardly from front and rear edges of the window 113a.

Figure 2:
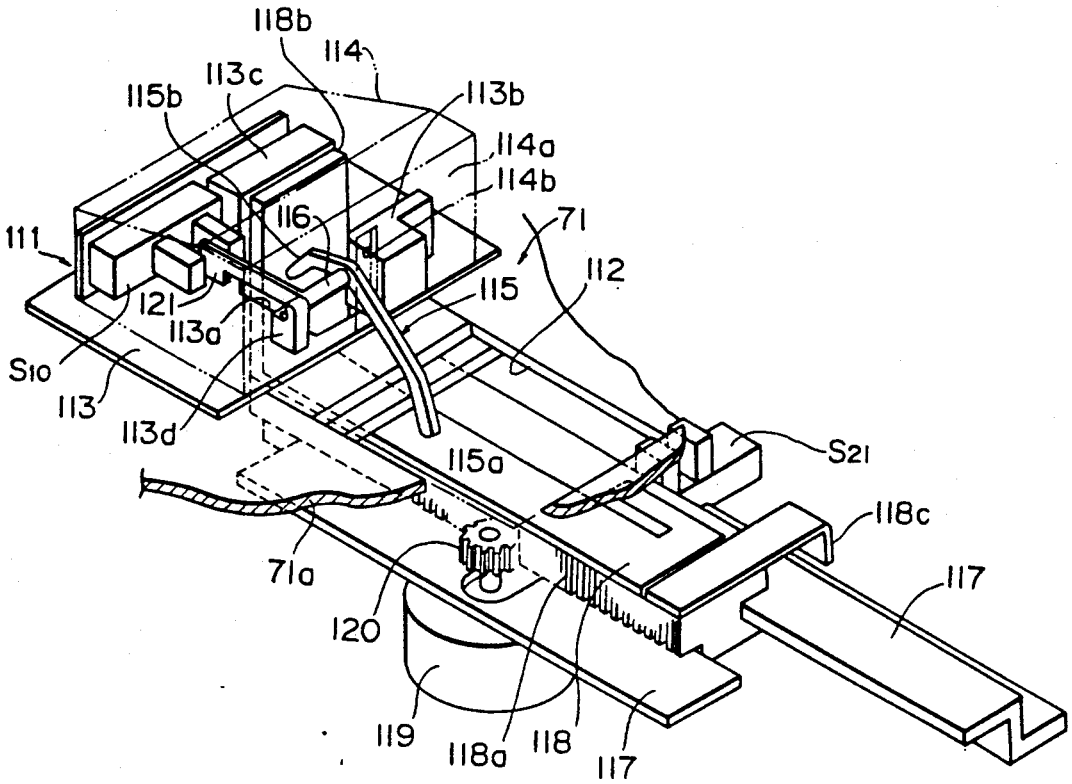
FIG. 2 is a perspective view of a positioning member and a drive mechanism therefor, both employed in the copying machine.

The front passive projection 113b is disposed at a right-hand portion of the front edge of the window 113a and supports a last document detecting lever 115 in cooperation with a bearing projection 113d formed in opposition to the passive projection 113b at a left-hand portion of the front edge of the window 113a. Specifically, this detecting lever 115 is pivotably mounted on a shatft 116 having its opposite ends received by the projections 113b and 113d and has a tip 115a and a tail 115b opposite to each other, said tip 115a protruding outwardly and forwardly through a vertical slit 114b which is defined in the position regulating face 114a of the cover 114. Since the detecting lever 115 is pivotably mounted on the shaft 116 at a location adjacent the tail 115b, this detecting lever 115 tends to pivot clockwise about the shaft 116 as viewed in FIGS. 3 to 8 by the effect of the weight of an end portion thereof adjacent the tip 115a, with tip 115a consequently tending to contact the base plate 113 as shown in FIG. 2. An end portion of the detecting lever 115 adjacent the tail 115b is so bent that, when and so long as the detecting lever 115 is stabilized with the tip 115a contacting the base plate 113, the tail 115b can be oriented downwards so as to assume a position adjacent the passive projection 113c.

A generally elongated slider 118 is supported beneath the document support tray 71 for movement in a direction parallel to the longitudinal sense thereof along a pair of guide rails 117 arranged on respective sides of the slider 118. This slider 118 has one side thereof formed with a rack gear 118*a* which is constantly meshed with a pinion gear 120 mounted on a drive shaft of a drive motor 119 carried by one of the guide rails 117. The drive motor 119 is of a reversible type and, therefore, depending on the direction of rotation of the drive motor 119, the slider 118 can be moved in one of directions opposite to each other and parallel to the longitudinal sense of the slider 118.

Figure 3:
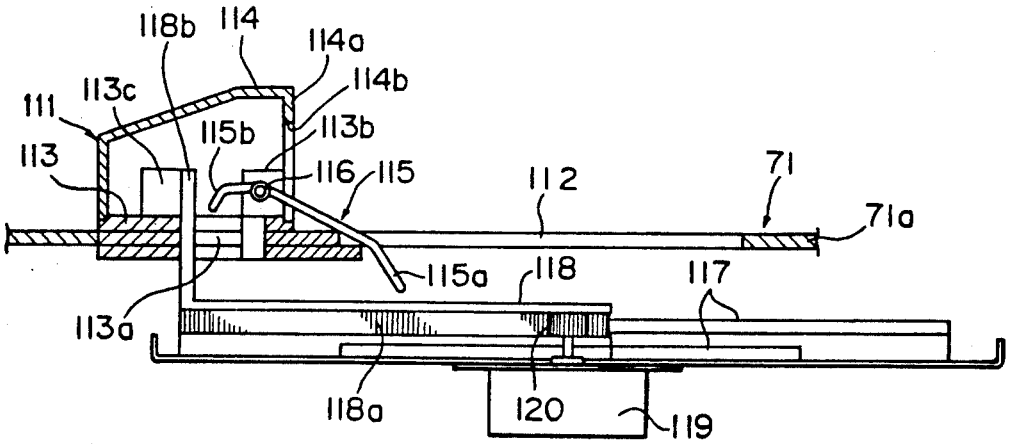
FIGS. 3 to 8 are sectional views showing the positioning member and a last document detecting lever provided therein, at different operative positions, respectively.
Figure 4:
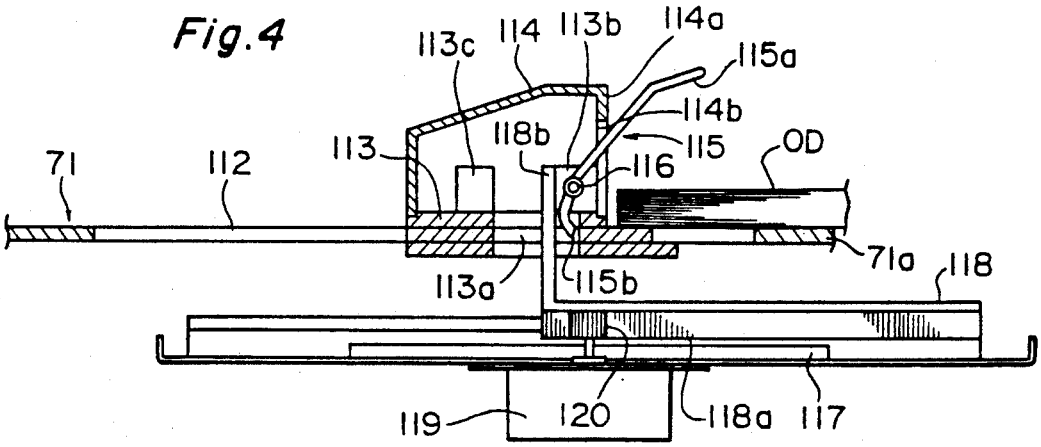
Figure 5:
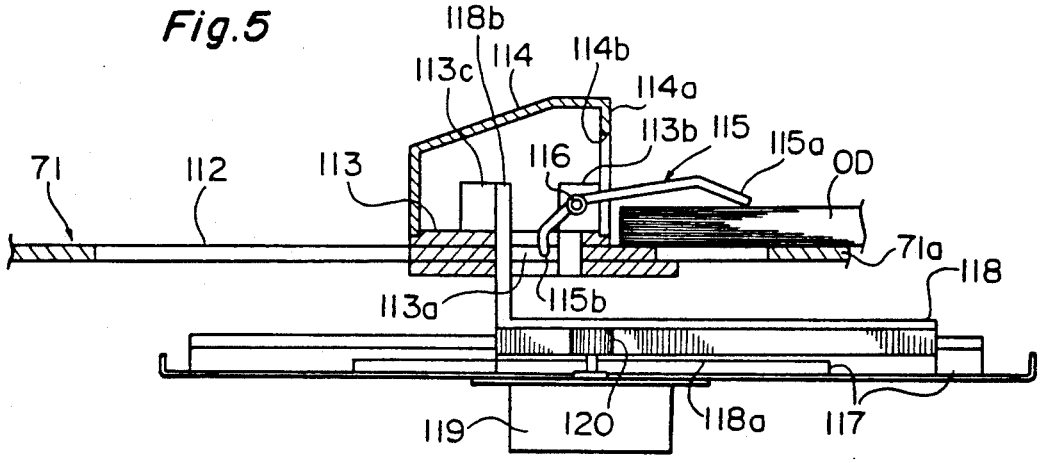

A rear end of the slider 118 is formed with an upright projection 118*b* extending upwardly therefrom through the window 113*a* in the base plate 113 into a space between the passive projections 113*b* and 113*c*. Therefore, when the slider 118 is moved forwards from a home position as shown in FIGS. 1 to 3, the upright projection 118*b* is brought into contact with the tail 115*b* of the detecting lever 115 from a condition shown in FIG. 3, pushing the tail 115*b* of the detecting lever 115 to cause the latter to pivot counterclockwise about the shaft 116 with the tip 115*a* consequently raised upwards as shown in FIG. 4. The upright projection 118*b* is subsequently brought into contact with the passive projection 113*b* on the base plate 113 and, thereafter, the positioning member 111 continues its rightward movement until it arrives at a predetermined position. However, since the tip 115*a* of the detecting lever 115 is upwardly raised during this movement of the positioning member 111 towards the predetermined position, it remains raised upwardly without interfering with the documents OD placed on the document support tray 71 or the document OD returned to the document support tray 71 and subsequently, the position regulating face 114*a* is subsequently brought into contact with the rear edges of the documents OD to urge the latter against the suffling roller pair 77 to facilitate a positive feed of each of the documents OD through the shuffling roller pair 77. After having pressed a predetermined amount, the slider 118 is slightly retracted backwards as shown in FIG. 5, allowing the upright projection 118*b* to finally separate from the tail 115*b* of the detecting lever 115. At this time, the detecting lever 115 is free to pivot and, therefore, by the effect of the weight of that end portion of the detecting lever 115 adjacent the tip 115*a*, the detecting lever 115 pivots clockwise with the tip 115*a* consequently lowered to rest on the stack of the documents OD as shown in FIG. 5.

Figure 6:
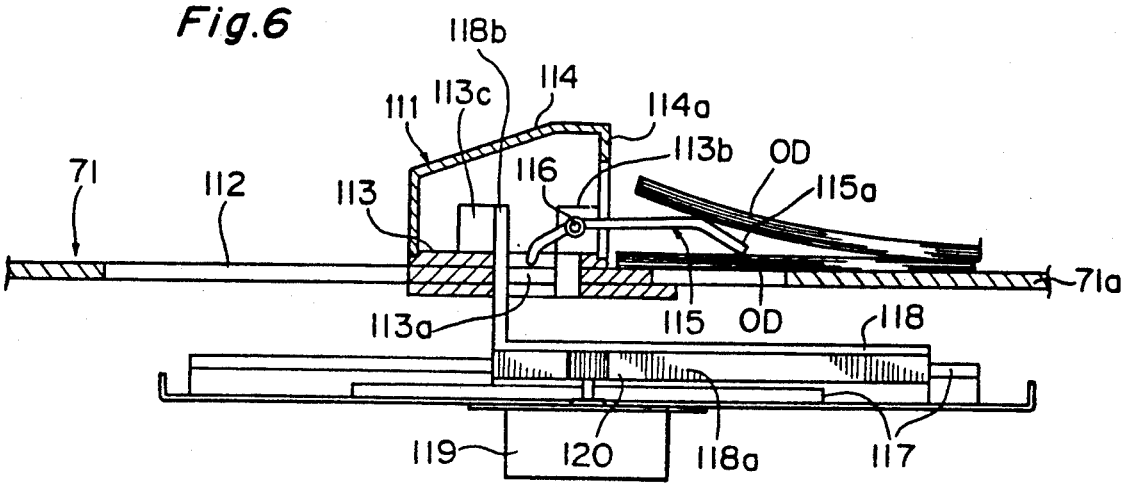

When the copying of the documents OD takes place successively during this condition shown in FIG. 5, the documents OD returned successively to the document support tray 71 after the actual copying rest above the tip 115*a* of the detecting lever 115 as shown in FIG. 6.

Figure 7:
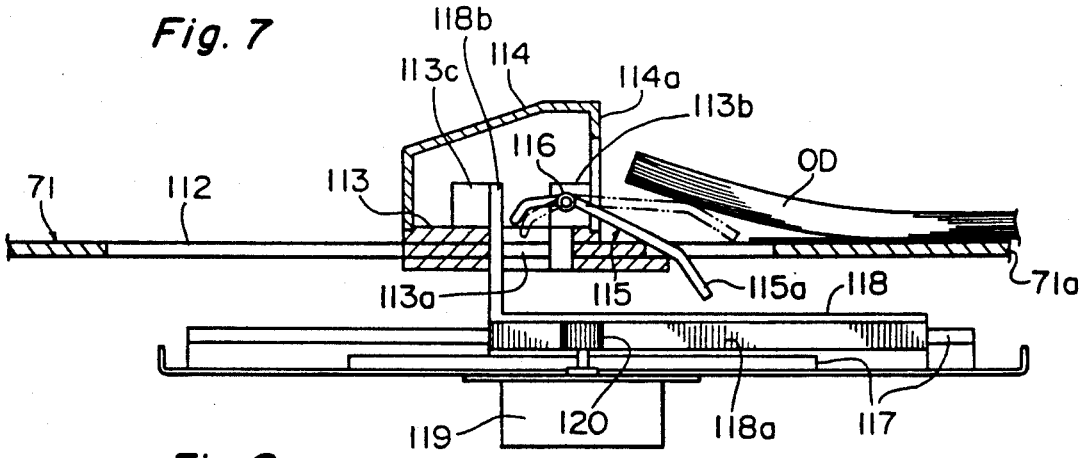
Figure 8:
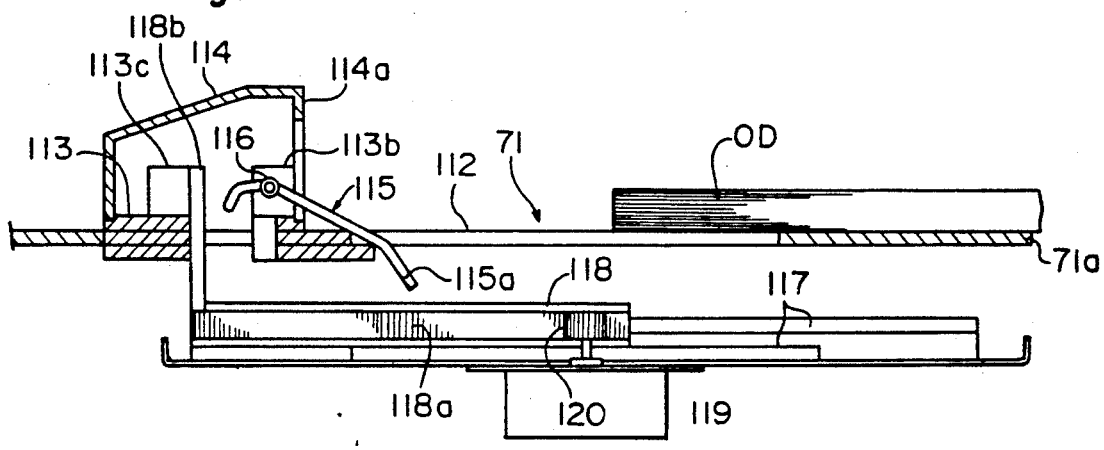

When the last document OD within the document support tray 71 is supplied as shown in FIG. 7, the detecting lever 115 is further pivoted clockwise about the shaft 116 with the tip 115*a* of the detecting lever 115, which has rested on the last document OD as shown by the phantom line in FIG. 7, consequently further lowered downwards to assume a stabilized position as shown by the solid line in FIG. 7. This further pivot of the detecting lever 115 about the shaft 116 is detected as it intercepts the passage of rays of light in a photosensor $S_{10}$ which subsequently provides an electric detection signal indicative of the feed of the last one of the stack of the documents OD within the document support tray 71. This photosensor $S_{10}$ is fixed to an inner wall surface of the cover 114.

It is to be noted that the positioning member 111 is so designed as to move from the home position a distance appropriate to the size of the documents OD, and the positioning of the positioning member 111 at the home position can be detected by a photosensor $S_{21}$ which is fixed to the guide rail 117 so as to detect an interceptor projection 118*c* rigidly secured to the slider 118 as shown in FIG. 2.

Figure 16:
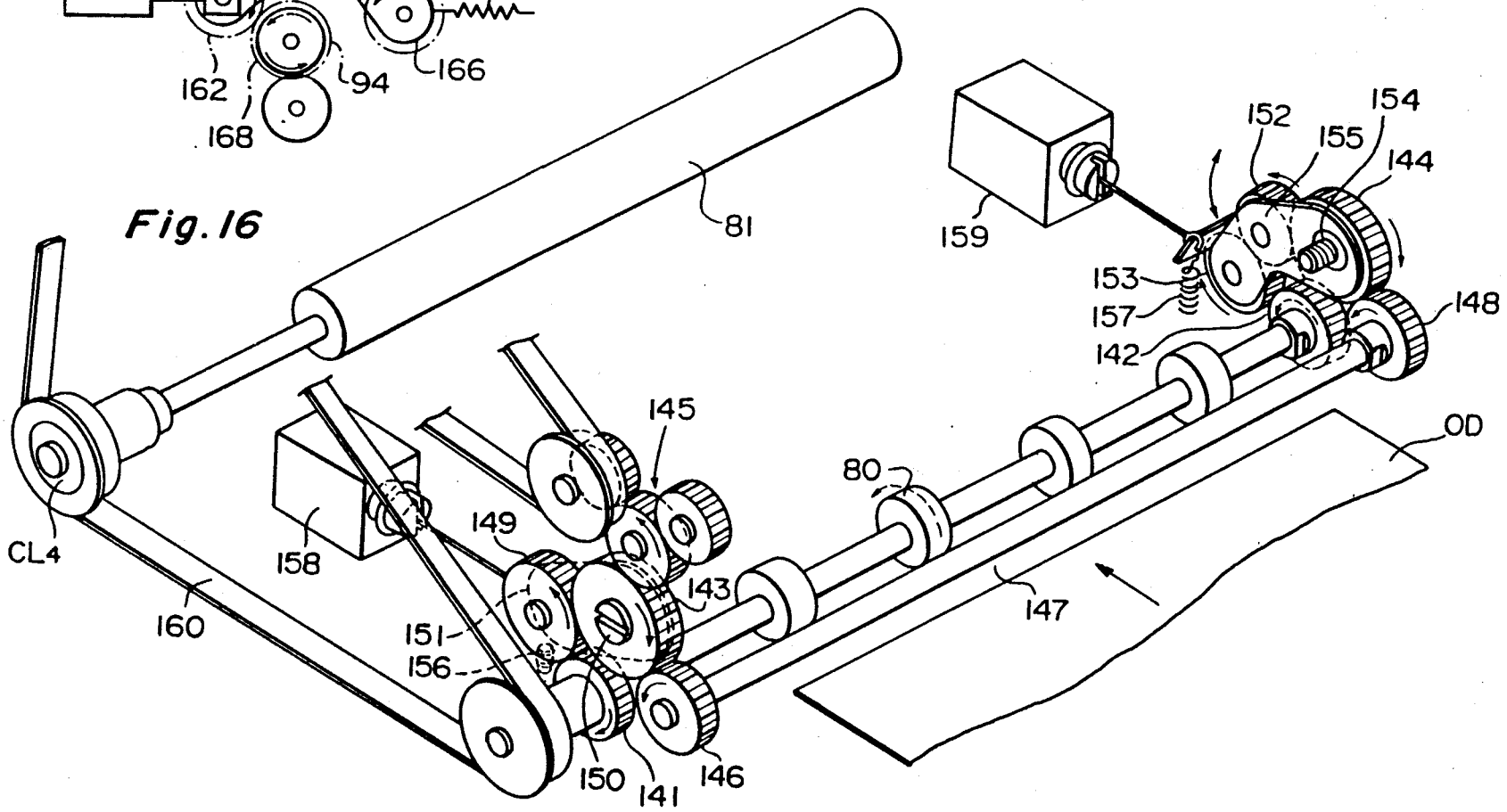
FIG. 16 is a perspective view of a reversible drive mechanism for a document transport system.

Of the reversible rollers 80 to 83, 85, 94, 100, 100 and 301, only the manual feed roller 94 is controlled so as to rotate in one of the opposite directions at a timing different from that at which any one of the remaining rollers is driven. FIG. 16 illustrates the delivery roller 80 and the timing roller 81 and their associated reversible drive mechanism, reference to which will now be made.

The delivery roller 80 has driven gears 141 and 142 mounted on opposite ends thereof which are meshed respectively with drive gears 143 and 144 so as to receive respective drives therefrom. One of the drive gears, that is, the drive gear 143, is adapted to receive a drive directly from a roller drive mechanism 145, whereas the other drive gear 144 is adapted to receive the drive from the roller drive mechanism 145 through a gear 146 meshed with the drive gear 143 and then through a gear 148 drivingly coupled with the gear 146 through a transmission shaft 147. Accordingly, the drive gears 143 and 144 can be driven simultaneously in the same direction and can be brought to a halt simultaneously.

The drive gear 143 is also meshed constantly with an idle gear 149 which is rotatably mounted on an arm 151 which is in turn rotatably mounted on a rotary shaft 150 of the drive gear 143. Therefore, the idle gear 149 can be selectively engaged with and disengaged from the driven gear 141 by a pivot movement of the arm 151 without being disengaged from the drive gear 143. So long as this idle gear 149 is engaged with the driven gear 141, the delivery roller 80 can be driven in one of the opposite directions, that is, a first direction, shown by the arrow in FIG. 16.

On the other hand, the drive gear 144 is engaged with an idle gear 152 which is in turn engaged with another idle gear 153. The idle gears 152 and 153 are rotatably supported by an arm 155 which is in turn pivotably mounted on a rotary shaft 154 of the drive gear 144 with the idle gear 153 meshed constantly with the drive gear 144. Depending on a pivot movement of the arm 155, the idle gear 153 can be selectively engaged with and disengaged from the driven gear 142 and, so long as the idle gear 153 is engaged with the driven gear 142, the delivery roller 80 can be driven in the other of the opposite directions, that is, a second direction counter to the first direction as shown by the broken line.

Thus, it is clear that the delivery roller 80 can be driven in one of the first and second directions opposite to each other depending on whether the drive gear 141 is drivingly coupled therewith through the single idle gear 149 or whether the drive gear 142 is drivingly coupled therewith through the two idle gears 152 and 153.

For the selection of the direction of rotation of the delivery roller 80, not only are the arms 151 and 155 biased by respective springs 156 and 157 so as to cause the idle gears 149 and 153 to be engaged with the driven gears 141 and 142, but also solenoid units 158 and 159 are operatively coupled with the respective arms 151 and 155. Therefore, when those solenoid units 158 and 159 are electrically energized, the associated arms 151 and 155 are pivoted against the respective springs 156 and 157 to disengage the idle gears 149 and 153 from the corresponding driven gears 141 and 142. Therefore, when only the solenoid unit 158 is electrically deenergized, the idle gear 149 is engaged with the driven gear 141 to drive the delivery roller 80 in the first direction, but when only the solenoid unit 159 is electrically deenergized, the idle gear 153 is engaged with the driven gear 142 to drive the delivery roller 80 in the second direction.

The rotation of the delivery roller 80 is coupled through a timing belt 160 with the timing roller 81 and any other rollers which are reversibly driven in one of the opposite directions. It is, however, contemplated to couple them with the roller drive mechanism 145 through any suitable reverse drive mechanism. The timing roller 81 is adapted to receive a driving force through a clutch $CL_4$ so that it can be independently brought to a halt for the purpose of a loop processing and/or a timing adjustment.

Figure 17:
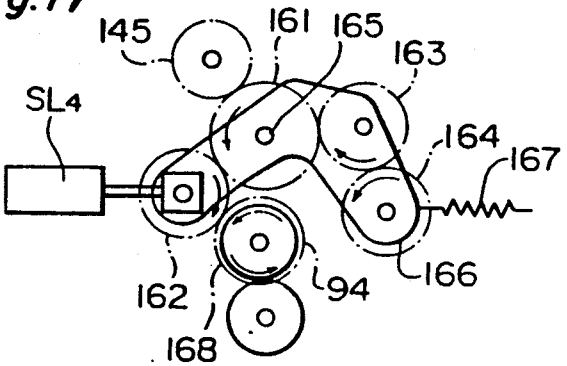
FIG. 17 is a perspective view of a reversible drive mechanism for a manual feed roller.

A reverse drive mechanism for the manual feed roller 94 is best shown in FIG. 17. A drive gear 161 adapted to be driven by the roller drive mechanism 145 is meshed with a first idle gear 162 and second idle gears 163 and 164 positioned on respective sides thereof. Those idle gears 162, 163 and 164 are rotatably supported by an arm 166 having a generally intermediate portion thereof mounted pivotably on a rotary shaft of the drive gear 161. The arm 166 carrying the idle rollers 162 to 164 is biased by a spring 167, acting on the arm 166, so as to cause the idle gear 162 to be constantly meshed with a driven gear 168 of the manual feed roller 94 so that the manual feed roller 94 can be driven in a first direction shown by the solid line. The arm 166 is also coupled with a reverse drive solenoid unit $SL_4$ so that, when the solenoid unit $SL_4$ is electrically energized, the arm 166 can be pivoted against the spring 167 to disengage the first idle gear 162 from the driven gear 168 and to engage the second idle gear 164 with the driven gear 168 to drive the manual feed roller 94 in the opposite, second direction shown by the broken line.

Figure 18:
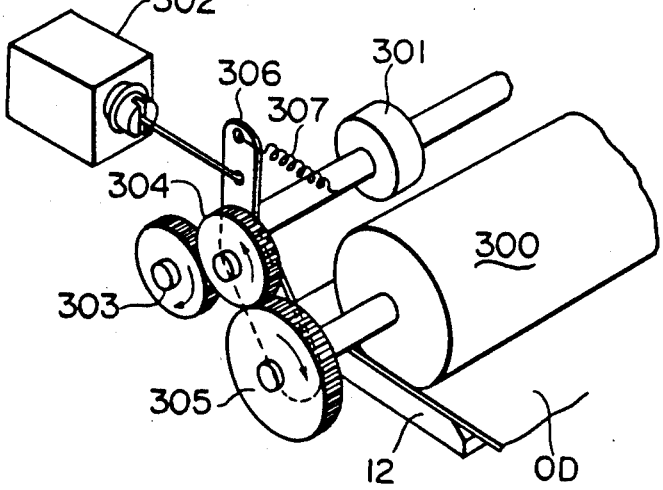
FIG. 18 is a perspective view of a drive mechanism for an exposure roller.
Figure 19:
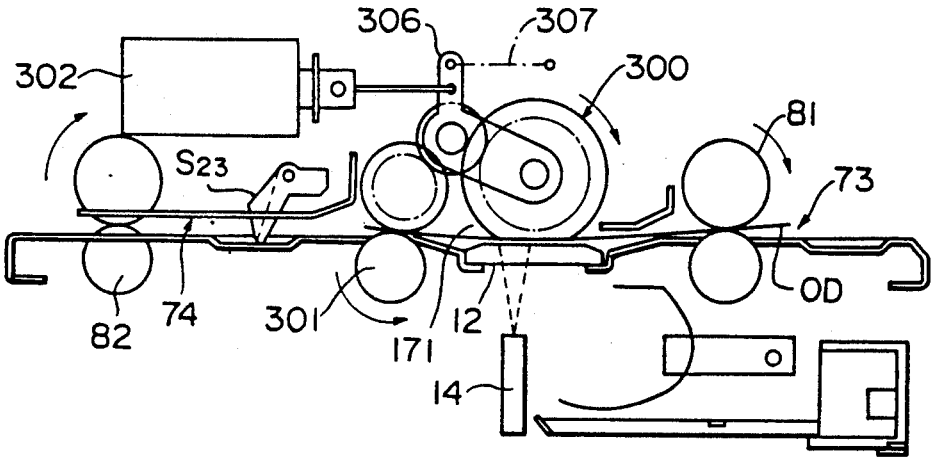
FIGS. 19 and 20 are side views showing the exposure roller in different operative positions, respectively.
Figure 20:
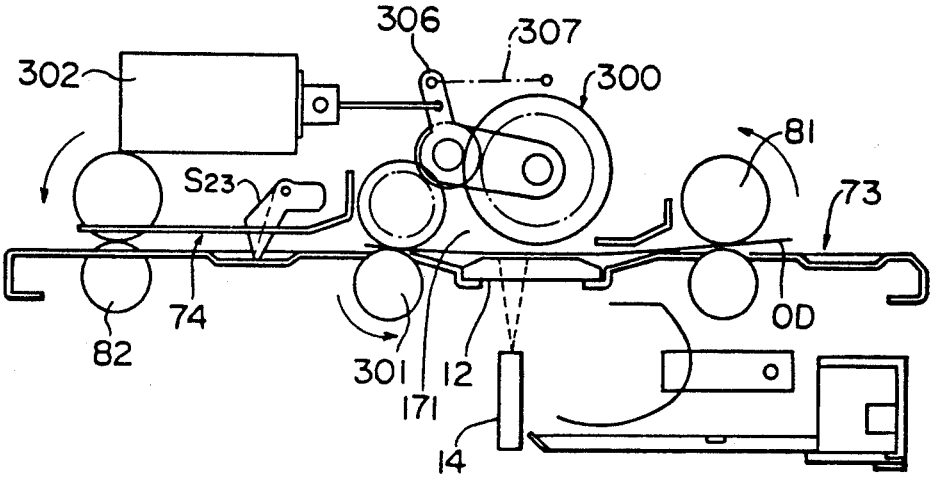

As best shown in FIGS. 18 to 21, the exposure roller 300 has one end supported by one end of a lever 306 having the other end thereof coupled with a solenoid unit 302 and is adapted to be driven by a drive transmitted thereto from the delivery roller 301 by way of a gear 303 drivingly coupled with the delivery roller 301 and then through gears 304 and 305 carried by the lever 306. When the document OD is fed, the solenoid unit 302 is electrically energized to cause the exposure roller 300 to be separated upwardly from the glass platen 12 against the biasing force of a spring 307 acting on the lever 306 as shown in FIG. 20. When the document OD so supplied is subsequently held still by the timing roller 81, the solenoid unit 302 is electrically deenergized to render to the lever 306 free to pivot and, therefore, by the biasing force of the spring 307, the exposure roller 300 is lowered to contact the glass platen 12 with the document OD sandwiched therebetween as shown in FIGS. 18 and 19. So long as the document OD is transported from the timing roller 81 and is exposed at the document reading station, the document OD is pressed against the glass platen 12 by the exposure roller 300 to keep an image of the document focused at all times during the exposure.

When no exposure takes place during the reverse feed of the document OD at the time of, for example, the copying operation in a grouping mode, the exposure roller 300 is retracted upwards away from the glass platen 112 as shown in FIG. 20 thereby to allow a free passage of the document OD beneath the exposure roller 300 and above the glass platen 12.

Figure 21:
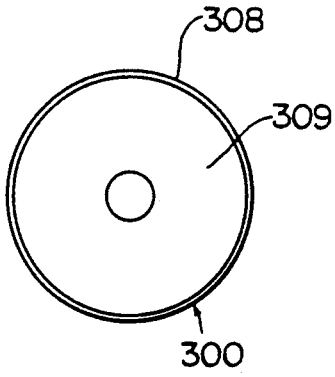
FIG. 21 is a side view of the exposure roller.

The exposure roller 300 which may be utilized in the practice of the present invention comprises, as best shown in FIG. 21, an inner layer 309 made of material having a low elasticity, for example, a soft, foamed resin, and a surface layer 308 made of material, such as, for example, Moltopren, having a high coefficient of friction which does not interfere with an elastic deformation of the inner layer 309. This is for the purpose of rendering the exposure roller 300 to have a predetermined width of contact with the glass platen 12 as a result of the deformation which takes place when the exposure roller 300 is pressed against the glass platen 12. The predetermined width of contact referred to above means a contact width required to cover a width of exposure accomplished by the lens array 14 and, where the exposure roller 300 is disposed offset in position relative to the exposure station in a direction close towards the feed passage 73 such as in the illustrated embodiment of the present invention, the contact width is required to be greater than the exposure width so that the exposure width can be covered thereby. By this design, when the exposure roller 300 presses the document OD against the glass platen 12 at the exposure station, the document OD can be pressed against the glass platen 12 in a width greater than the exposure width for presentation to the exposure and this can be accomplished over the entire length of the document OD.

Figure 22:
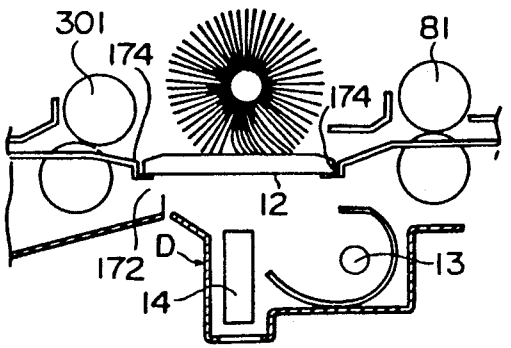
FIG. 22 is a sectional view showing a modified form of the exposure roller.

If the outer surface of the exposure roller 300 is rendered white in color, a surface portion of the exposure roller 300 that is held in contact with the glass platen 12 through the document OD will provide a background for the document OD at the exposure station and, therefore, the possibility can be avoided wherein, though the position of the document OD is slightly displaced, a portion of the document OD not correctly positioned at the exposure station may be copied as a black shade.

Where the role of the exposure roller is merely to press the document OD against the glass platen 12, it suffices for the exposure roller 300 to satisfy the coefficient of friction of the outer surface thereof and the softness thereof and, therefore, it may be in the form of a fur brush 300*a* as shown in FIG. 22.

Figure 23:
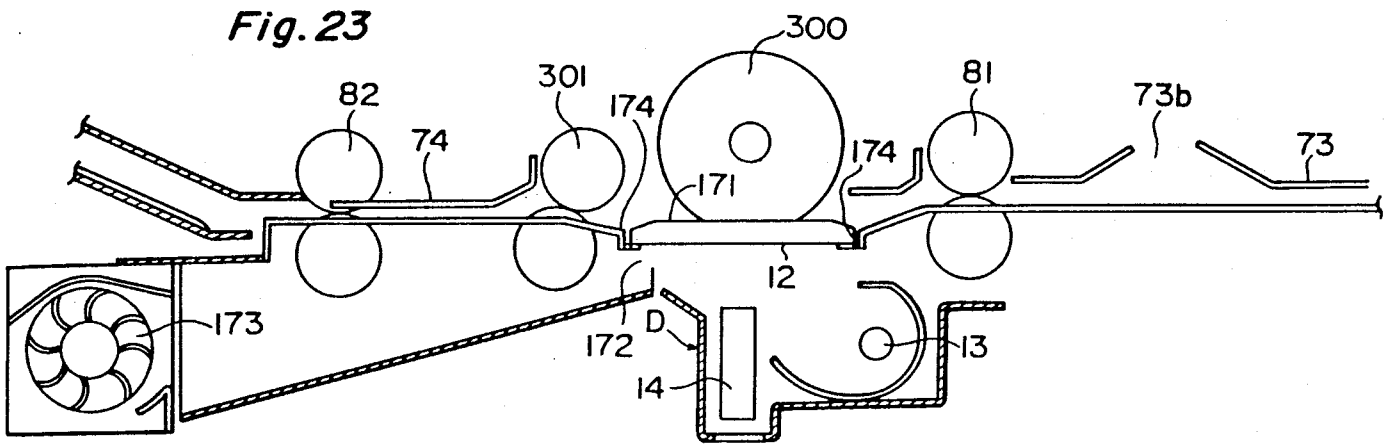
FIGS. 23 and 24 are sectional views showing an exposure unit before a document is transported therethrough and during the transportation of the document therethrough, respectively.
Figure 24:
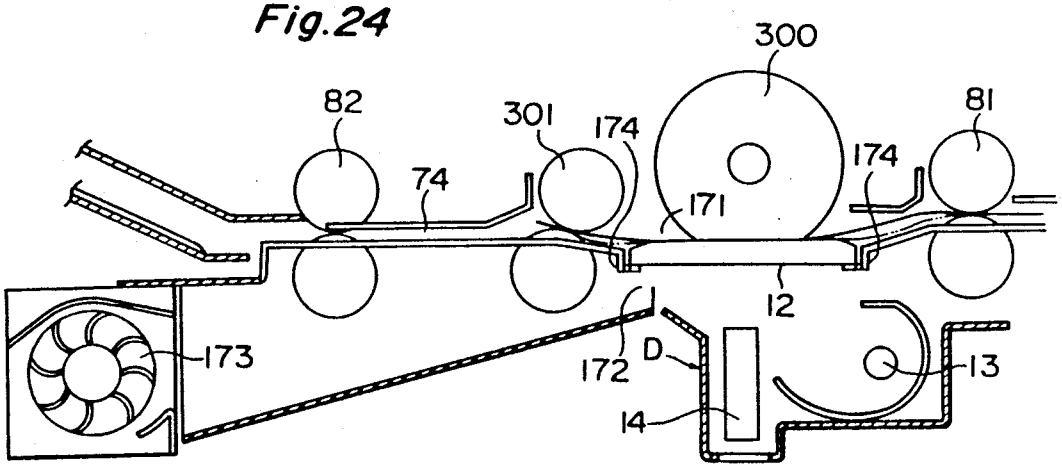

As best shown in FIGS. 1, 23 and 24, a ventilating passage duct 172 for the flow of a cooling air is formed beneath the glass platen 12 and is communicated at one end with a fan 173 operable to produce a stream of cooling air. This cooling system is required where the copying machine is of a type wherein the document is moved past the exposure station while the optical system is fixed. In other words, in the copying machine of the type wherein the document is moved past the exposure station while the optical system is fixed, no return motion of the optical system is required such as used in a copying machine of a type wherein the document is held stationary and the optical system is moved to scan the document, and therefore, copying can be accomplished merely by passing the documents successively over the exposure station. In this type of copying machine, the illuminator lamp 13 is usually kept lit during the repeated passage of the document or during the successive passage of the documents so as to illuminate the documents through the glass plate 12 and, therefore, the glass platen 12 is apt to be heated to a substantial temperature. In order to avoid this, the cooling system is employed to ventilate heated air to keep the glass platen 12 cool.

Slits 174 are defined on respective sides of the glass platen 12 so as to extend over the entire width of an exposure guide passage 171 and spaced from each other in a direction parallel to the direction of movement of each document, which slits 174 are communicated with the ventilating duct 172 and the exposure guide passage 171. Because of the employment of the slits 174, a stream of cooling air induced by the fan 173 and flowing through the ventilating duct 172 in a direction shown by the arrow in FIG. 24 would result in a development of a negative pressure within the ventilating duct 172 and immediately below the glass platen 12, acting to draw air from the exposure guide passage 171 into the ventilating duct 172. The flow of air drawn from the exposure guide passage 171 into the ventilating duct 172 by the effect of the negative pressure so developed can be advantageously utilized to cool the glass platen 12. This flow of air also acts to draw the document OD, ready to pass over the glass platen 12, slightly downwards to ensure a contact between the upper surface of the glass platen and the document OD. However, each of the slits 174 and/or the ventilating duct 172 are so sized and so dimensioned that the flow of air drawn into the ventilating duct 172 by the effect of the negative pressure will not provide any obstructions to the regular passage of each document over the glass platen 12.

In order to endure the regular passage of each document OD along the exposure guide passage 171, the speed of transport of the document OD effected by each of the delivery rollers 82 and 301 is chosen to be equal to or slightly lower than the speed of transport effected by the timing roller 81, thereby to avoid any possible fast passage thereof.

Figure 25:
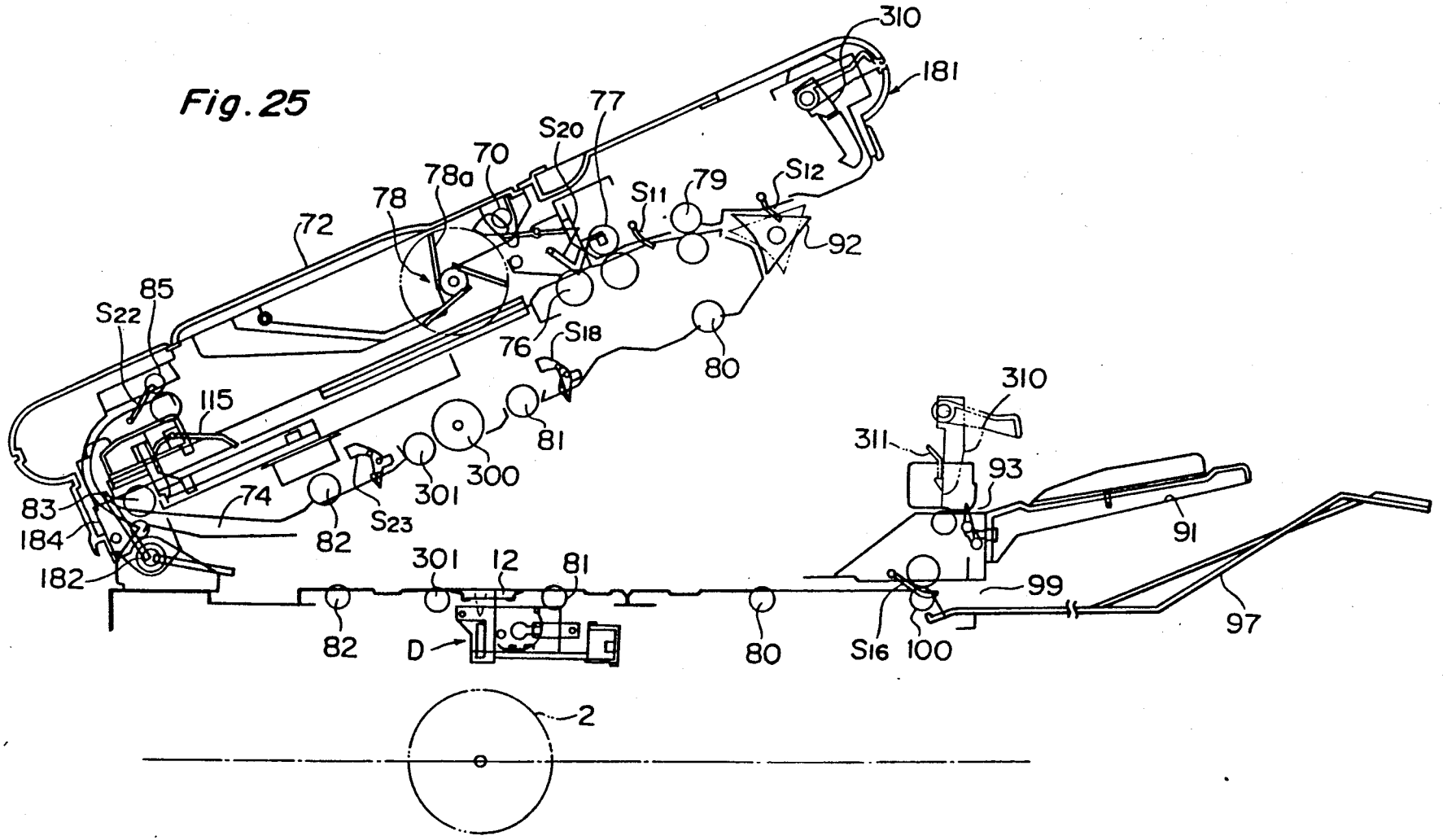
FIG. 25 is a sectional view showing a pivotable unit in an opened position.

As best shown in FIG. 25, an upper portion of the RDH block A which is above a line drawn through the manual feed passage 92 and the downstream passage portion 73*c* of the feed passage 73 and terminating at a position preceding the U-shaped path 74*a* of the circulating passage 74 is designed as a pivotable unit 181, while a lower portion of the RDH block A which is below said line is designed as a stationary unit. The pivotable unit 181 is hingedly connected through a shaft 182 to one end of the stationary unit by means of a shaft 182 remote from the manual feed table 91. The pivotable unit 181 includes a lock lever 310 which is automatically engaged with an engagement 311 in the stationary unit of the RDH block A to lock the pivotable unit 181 in a closed position relative to the stationary unit. To open the pivotable unit 181, the lock lever 310 has to be manipulated so as to disengage from the engagement 311.

When the pivotable unit 181 is opened, the passages on said line can be opened and, therefore, if the lid 71 is also opened during the opening of the pivotable unit 181, at least a portion of the documents jammed somewhere in the passages can be exposed to the outside, even though a certain short passage remains closed, to facilitate the manual removal of the jammed documents. Since the pivotable unit 181 is hinged to the stationary unit at a position remote from the manual feed table 91, the manual feed table 91 need not be removed from the machine housing during the opening of the pivotable unit 181. In particular, an outer block 183 of the U-shaped path 74*a* positioned remote from the manual feed table 91 is also hingedly connected to a portion of the pivotable unit 181 by means of a shaft 184 for selective opening and closing and, therefore, it can also be opened wide regardless of the manual feed table 91 to facilitate the removal of the documents jammed at a location around the U-shaped path 74*a*.

Positioned on an upstream side of the timing roller 81 is a sensor $S_{18}$ for detecting whether or not the document OD has been transported to the timing roller 81. A sensor $S_{23}$ for detecting the timing at which the leading edge of the document OD is registered with the image is also positioned on a downstream side of the delivery roller 301. Each of those sensors $S_{18}$ and $S_{23}$ is of a construction best shown in FIGS. 26 to 30.

Since the sensors $S_{18}$ and $S_{23}$ are of identical structure, reference will now be made to only one of those sensors, for example, the sensor $S_{23}$ in describing the details thereof with reference to FIGS. 26 to 30 for the sake of brevity.

As shown therein, the sensor $S_{23}$ comprises a reed switch 331 housed within a switch box, a base actuator 332 pivotally connected to the switch box through a first fulcrum 334 and a tip actuator 333 pivotally connected to the base actuator 332 through a second fulcrum 338. The reed switch 331 is fitted to a support plate 330*a* fixed to a document guide 330 and is adapted to magnetically detect the presence or absence of a movement of the base actuator 332 which will occur when a magnet 335 secured to a tail portion of the base actuator 332 moves angularly about the first fulcrum of the base actuator 332 in a direction close towards and away from the reed switch 331.

When and so long as the base actuator 332 is in a free condition such as shown in FIG. 24, in which condition the opposite end portions thereof carrying the magnet 335 and the tip actuator 333, respectively, are counterbalanced with respect to the first fulcrum 334, the magnet 335 is held in position close to the reed switch 331 and, in this condition, the reed switch 331 is switched off. On the other hand, when the magnet 335 moves away from the reed switch 331 as a result of a movement of the base actuator 332, the reed switch 331 is switched on.

Figure 26:
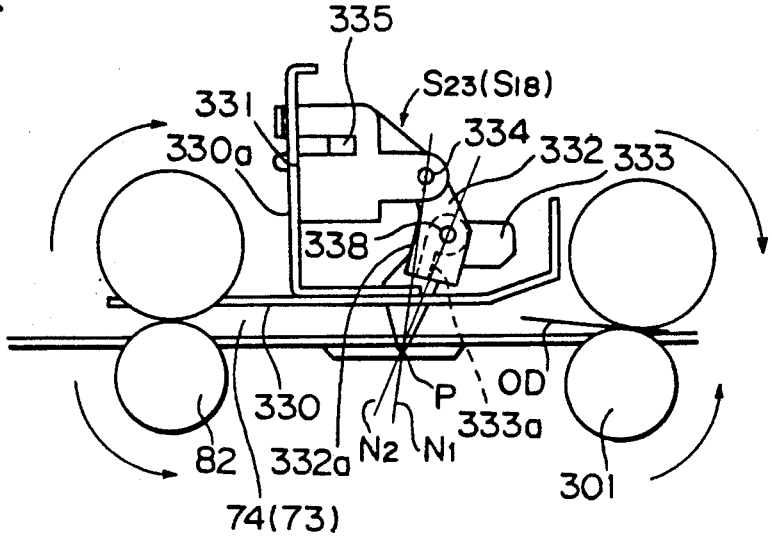
FIGS. 26 to 30 are side views showing a sheet passage detector in different operative positions, respectively.
Figure 29:
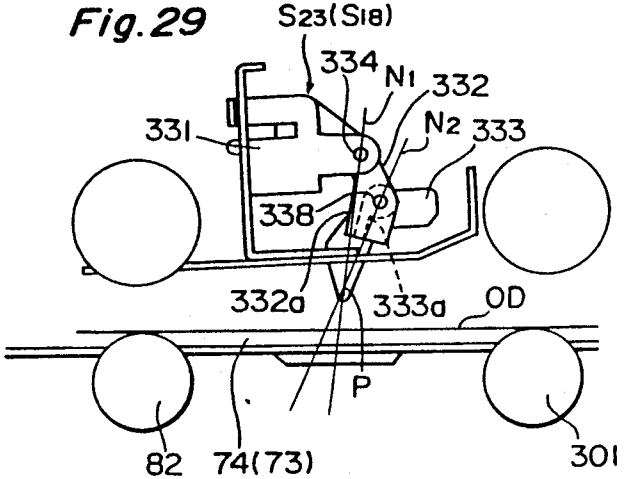

The tip actuator 333 and the base actuator 332 are formed with respective abutments 333*a* and 332*a* in face-to-face relationship with each other so that the tip actuator 333 can be pivoted together with the base actuator 332 in a direction conforming to the direction desired to be detected along which the document OD may pass. Normally they assume such a posture as shown in FIGS. 26 and 29 because of the engagement between the abutments 332*a* and 333*a* and because of the rotary balance about the second fulcrum 338. In other words, each of the base and tip actuators 332 and 333 depends from the first fulcrum 334 to a condition as shown in FIGS. 26 and 29 and this orientation will not vary regardless of the selective opening and closure of the pivotable unit 181 of the RDH block A and it can be reciprocately moved up and down in a direction generally perpendicular to the feed passage 73 while maintaining this condition.

Figure 27:
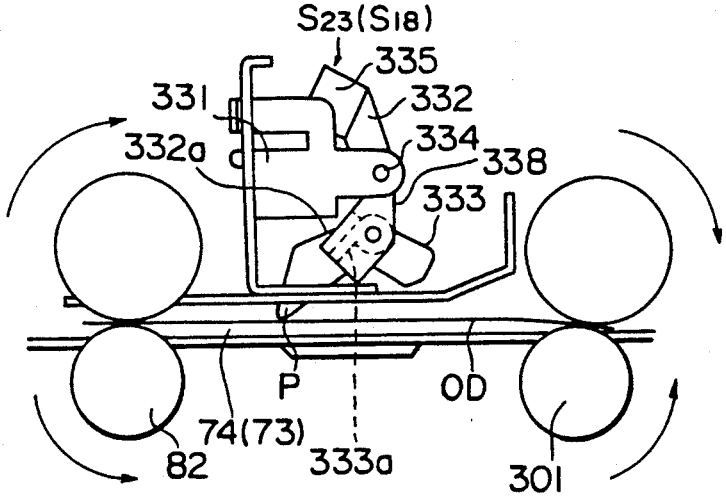

When the pivotable unit 181 is closed relative to the stationary unit, the tip actuator 333 moves as shown in FIG. 26 so as to traverse the feed passage 74. Accordingly, regardless of the direction of passage of the document OD in the feed passage 74, the document moving in the feed passage 74 can be brought into contact with the tip actuator 333 from lateral direction to push it.

Where the document is transported leftwards in the feed passage 74 for the exposure above the glass platen 12 as shown in FIGS. 26 and 27, the leading edge of the document OD with respect to the direction of movement thereof in the feed passage 74 pushes the tip actuator 333 leftwards to cause the tip actuator 333 to pivot clockwise about the second fulcrum 338 with the abutments 332*a* and 333*a* consequently brought into contact with each other. After the abutments 332*a* and 333*a* have been engaged with each other, the further pivotal movement of the tip actuator 333 results in a corresponding pivotal movement of the base actuator 332 about the first fulcrum 334 and, thereafter, the tip and base actuators 333 and 332 are pivoted together clockwise as shown in FIG. 27. At this time, consequent upon the pivotal movement of the base actuator 332, the magnet 335 moves away from the reed switch 331 to cause the latter to be switched on, thereby detecting the direction in which the document OD is exposed, that is, the passage of the document OD in a positive direction.

Figure 28:
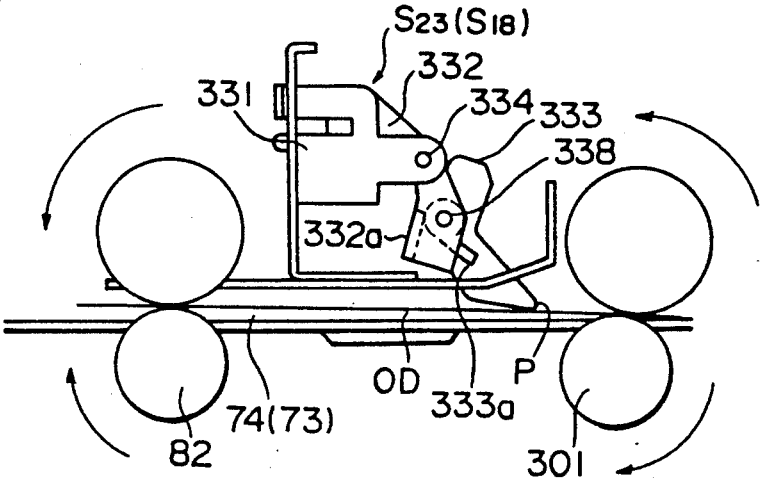

When the document OD is moved in a reverse direction counter to the positive direction, the document OD pushed the tip actuator 333 rightwards from lateral direction. Accordingly, the tip actuator 333 is pivoted counterclockwise about the second fulcrum 338 with the abutments 332*a* and 333*a* consequently disengaged from each other as shown in FIG. 28, allowing the tip actuator 333 to pivot independently of the base actuator 332 without interfering the passage of the document OD in the reverse direction. Since at this time the base actuator 332 is held still, the reed switch 331 remains switched off and does not detect the passage of the document OD.

It is to be noted that the movement of the tip actuator 333 in the direction in which the passage of the document OD is to be detected accompanies a corresponding movement of the base actuator 332. Therefore, unlike the movement thereof which takes place during the passage of the document in the reverse direction, which does not accompany any movement of the base actuator 332, any attempt to detect the movement of the tip actuator 333 with the use of the reed switch 331 is effective to detect only one of the positive and reverse directions that is required to be detected as is the case with the illustrated embodiment.

Also, in the illustrated embodiment, the position of each of the first and second fulcrums 334 and 338 relative to a point P of the tip actuator 333 which can be engaged with the document OD remaining in the feed passage 73 is so selected that each of imaginary lines $N_1$ and $N_2$ drawn from the point P to the first fulcrum 334 and from the point P to the second fulcrum 338, respectively, can incline relative to the feed passage 73.

Figure 30:
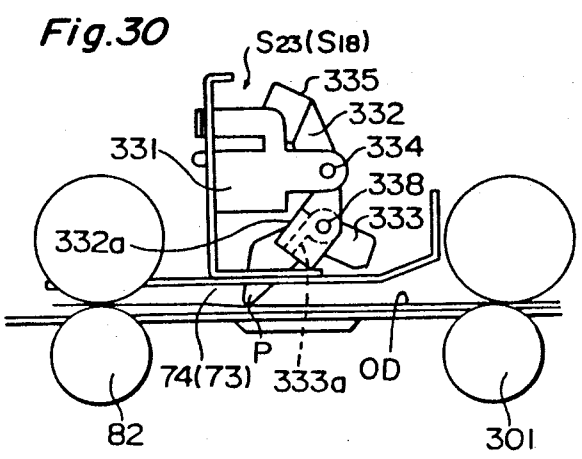

In view of the foregoing, even where the document OD remains in the feed passage 73 after the pivotable unit 181 once opened for some reason, for example, for the removal of the jammed condition has been closed, and when the base and tip actuators 332 and 333 held in the respective naturally depending condition are lowered to contact the remaining document OD, the tip actuator 333 will receive a rotary moment acting in the counterclockwise direction about the second fulcrum 338 which is induced by a contact reaction imposed on the point P and, therefore, the tip actuator 333 can be pivoted counterclockwise accompanied by a corresponding pivotal movement of the base actuator 332 about the first fulcrum 334 to escape from the remaining document OD, thereby avoiding the possibility that the point P of the tip actuator 333 will break through the remaining document OD as shown in FIG. 30. This escapement of the tip actuator 332 relative to the remaining document OD can be satisfactorily accomplished if either one of the imaginary lines $N_1$ and $N_2$ drawn from the point P to the first fulcrum 334 and from the point P to the second fulcrum 338, respectively, is chosen to incline relative to the feed passage 73. It is, however, to be noted that, where the position of the second fulcrum 338 is to be so positioned and so conditioned as described above, design must be made that it can receive a rotary moment acting in a direction in which the tip actuator 333 will not be pivoted together with the base actuator 332 by the effect of the contact reaction at the point P.

Since the manual feed table 91 is provided on the stationary unit of the RDH block A, it does not follow the selective opening and closure of the pivotable unit 181 and remains at a fixed position and, therefore, the document or documents OD placed thereon, or if placed thereon, will not fall from the manual feed table 91 during the selective opening and closure of the pivotable unit 181.

Figure 31:
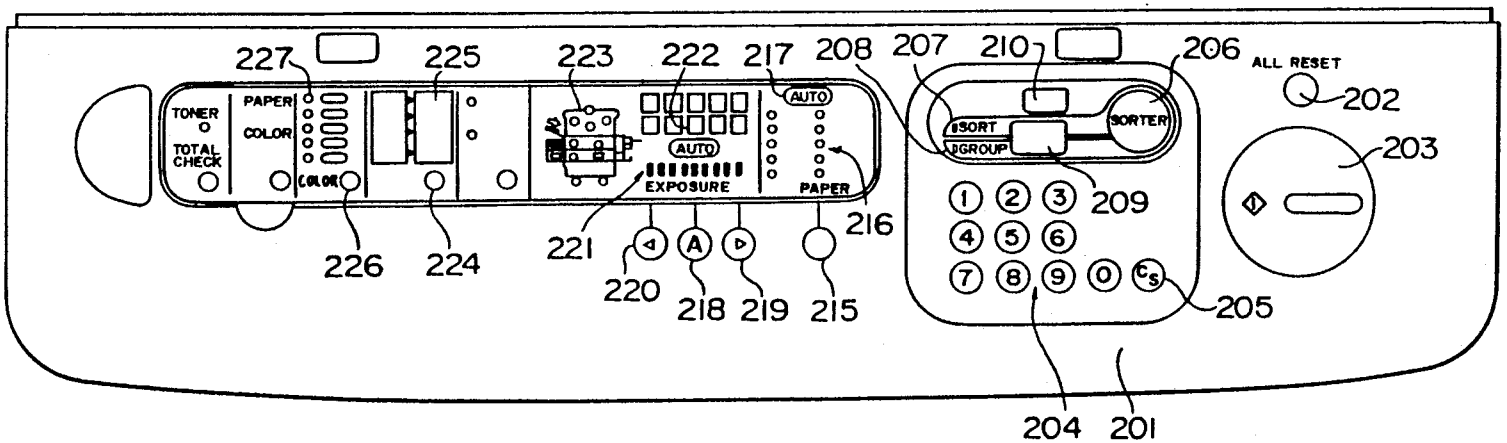
FIG. 31 is a plan view of an operating panel.

Referring now to FIG. 31, the pivotable unit 181 is provided with an operating panel 201 disposed on an upper surface thereof. In the order from right as viewed in FIG. 31, the operating panel 201 includes an All Reset key 202; a Print button 203 disposed below the All Reset key 202; a keyboard disposed immediately leftwards of the Print key 202 and including numeric input keys 204 and a Clear/Stop key 205; a Mode Select key 206; grouping and sorting mode display windows 207 and 208 which are selectively energized by the position of the Mode Select key 206; a numeric display window 209; and a document number display window 210.

The All Reset key 202 is adapted to reset all settings back to normal states when it is depressed. The Clear/-Stop key 205 is adapted to clear digits inputted by the numeric input keys 204 or, if the machine is under a copying operation, to stop the copying operation when it is depressed. The Mode Select key 206 is of a rotary type and is operable to change a mode being displayed over to another mode each time it is depressed.

The operating panel 201 also includes, positioned leftwardly of them, a Paper Select key 215; a size display window 216 and an automatic select display window 217 adapted to be selected by the Paper Select key 215; an Exposure Select key 218 for selecting one of an automatic exposure and a manual exposure in a rotary fashion; an Exposure Up key 219 and an Exposure Down key 220 positioned on respective sides of the Exposure Select key 218; and exposure level display window 221 for the manual exposure and an automatic exposure display window 222; a status display window 223 for indicating status of the copying machine 1; a Copy Mode Select key 224 of rotary time used to select one of simplex and duplex copying modes for each of a single-sided document and a double-sided document; a Copy Mode Select display window 225 for displaying the mode selected by the Copy Mode Select key 224; a Developer Select key 226; a color display window 227 for displaying the color of toner contained in one of developing units selected by the Developer Select key 226; and so on.

Figure 32:
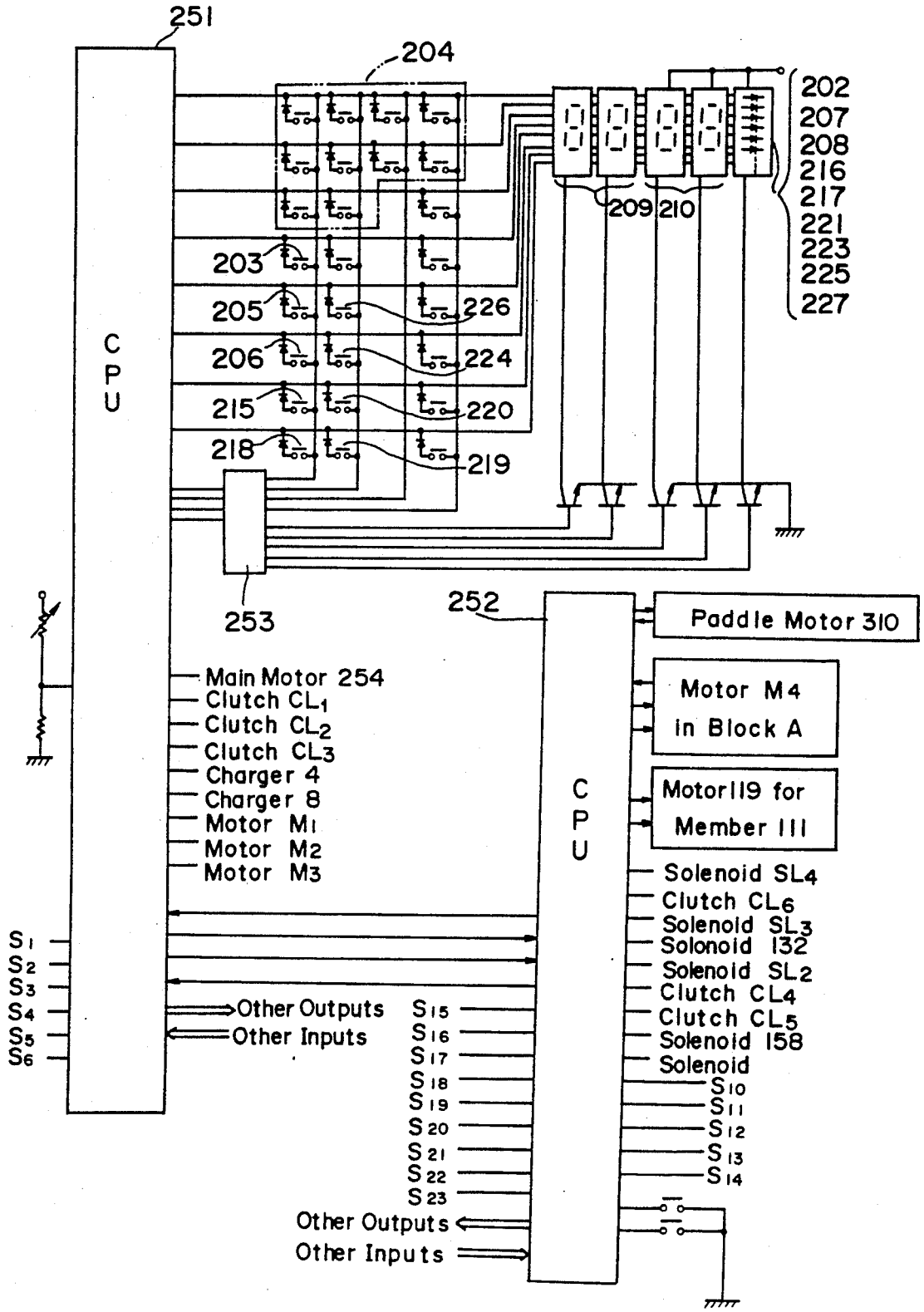
FIG. 32 illustrates a control circuit.

FIG. 32 illustrates a control circuit for carrying out a document feed and a corresponding copying operation in response to various settings made through the operating panel 201. As best shown therein, this control circuit comprises a first central processing unit (CPU) 251 for controlling an operation of the copier block B and a second central processing unit (CPU) 252 for controlling an operation of the RDH block A, said central processing units 251 and 252 being connected with each other so as to communicate with each other.

Referring to FIG. 32, the first central processing unit 251 is electrically connected through a decoder 253 with switches associated respectively with the various keys and display windows on the operating panel 201. Also connected with this central processing unit 251 are operating members to be controlled including a main motor 254, the clutch $CL_1$ for the registration roller 27, respective clutches $CL_2$ and $CL_3$ for the upper and lower paper feed rollers 25 and 26, the electrostatic charger 4, the transfer charger 8, motors $M_1$, $M_2$ and $M_3$ for the upper, intermediate and lower developing units, and so on, and various sensors $S_1$ to $S_6$ for synchronizing the various component parts in the copier block B and for the detection of recording papers for the detection of the occurrence of a jamming condition.

The second central processing unit 252 is connected with a drive motor M4 and a drive motor 119 for the positioning member 111, both in the RDH block A, and also with various sensors $S_{10}$ to $S_{23}$ installed at respective locations in the RDH block A and respective clutches $CL_4$, $CL_5$ and $CL_6$ operatively associated with the feed roller 76, the shuffling roller 77 and the timing roller 81. Further, the second central processing unit 252 is connected with a solenoid unit $SL_2$ for pressing the documents, a solenoid unit $SL_3$ for changing the direction of transport, and a reverse drive changeover solenoid unit $SL_4$.

Hereinafter, the operation of the copying machine embodying the present invention will be described.

Figure 33:
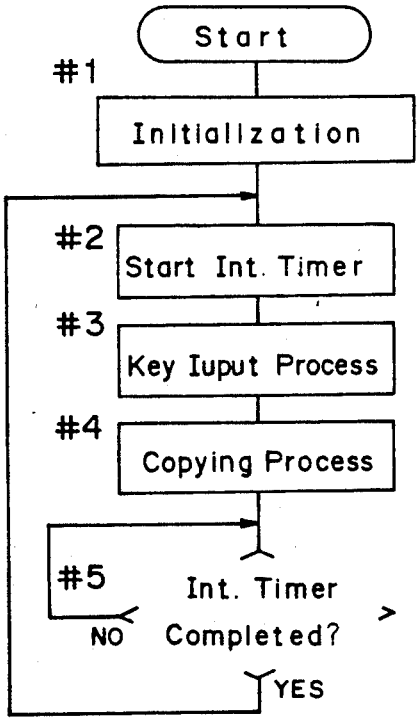
FIG. 33 is a flowchart showing a main control routine executed by a first central processing unit in a copier block.
Figure 34:
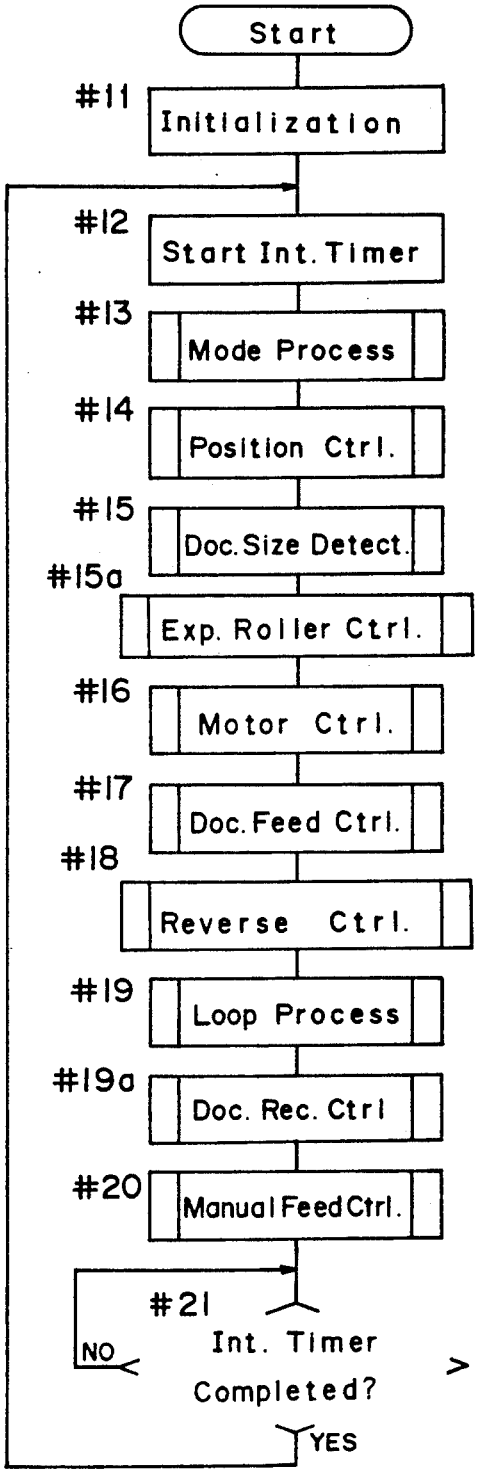
FIG. 34 is a flowchart showing a main control routine executed by a second central processing unit in a document feeder block.

The copying operation takes place under the control of the first central processing unit 251 programmed to control the operation of the copier block B according to a schematic main routine shown in FIG. 33 and also under the control of the second central processing unit 252 programmed to control the operation of the RDH block B according to a schematic main routine shown in FIG. 34.

In the first place, the copying operation in which single-sided documents each having an image on only one side thereof are copied on recording papers to form respective simplex copies having the reproduced image on only one side of the respective recording paper while the single-sided documents are automatically successively supplied under a sorting mode will be described.

A stack of single-sided documents OD is placed face up within the document support tray 71 after the lid 72 has been opened. At this time, the positioning member 111 is held at the home position which is the most rearwardly retracted position, and a document retainer 66 confronting the feed roller 76 is held at an upwardly retracted position, while the stopper 75 is lowered to a document stop position in operative association with the opening of the lid 72. Accordingly, the stack of the single-sided document OD can be inserted into the document support tray 71 without being obstructed by the positioning member 111 and the document retainer 66. The stack of the document OD so placed within the document support tray 71 should be adjusted in position until the leading edges of those stacked documents OD can be brought into contact with the stopper 75, followed by the closure of the lid 72. In response to the closure of the lid 72, the stopper 75 is upwardly retracted to allow successive feed of the stacked documents OD. Thereafter, the sorting mode is to be selected by means of the mode select key 206 and, at the same time, the number of copies desired to be made is set by manipulating some of the numeric input keys 204.

Then, a single-sided document, simplex copying mode is selected by means of the copy mode select key 224 and, after some other necessary keying has been made, the Print button 203 is manipulated. Once the Print button 203 has been manipulated, the main routine shown in FIG. 33 is executed in the copier block B by the first central processing unit 251 and, after a key input process, a simples copying from each of the stacked documents OD is carried out in a sorting mode to selected, or automatically selected, recording papers in a selected number. At this time, the timing at which each of the recording papers is supplied during the copying operation is synchronized with the timing at which the corresponding document OD is supplied to the exposure station in the RDH block A as determined by a transmission of signals between the first and second central processing units 251 and 252.

Figure 35:
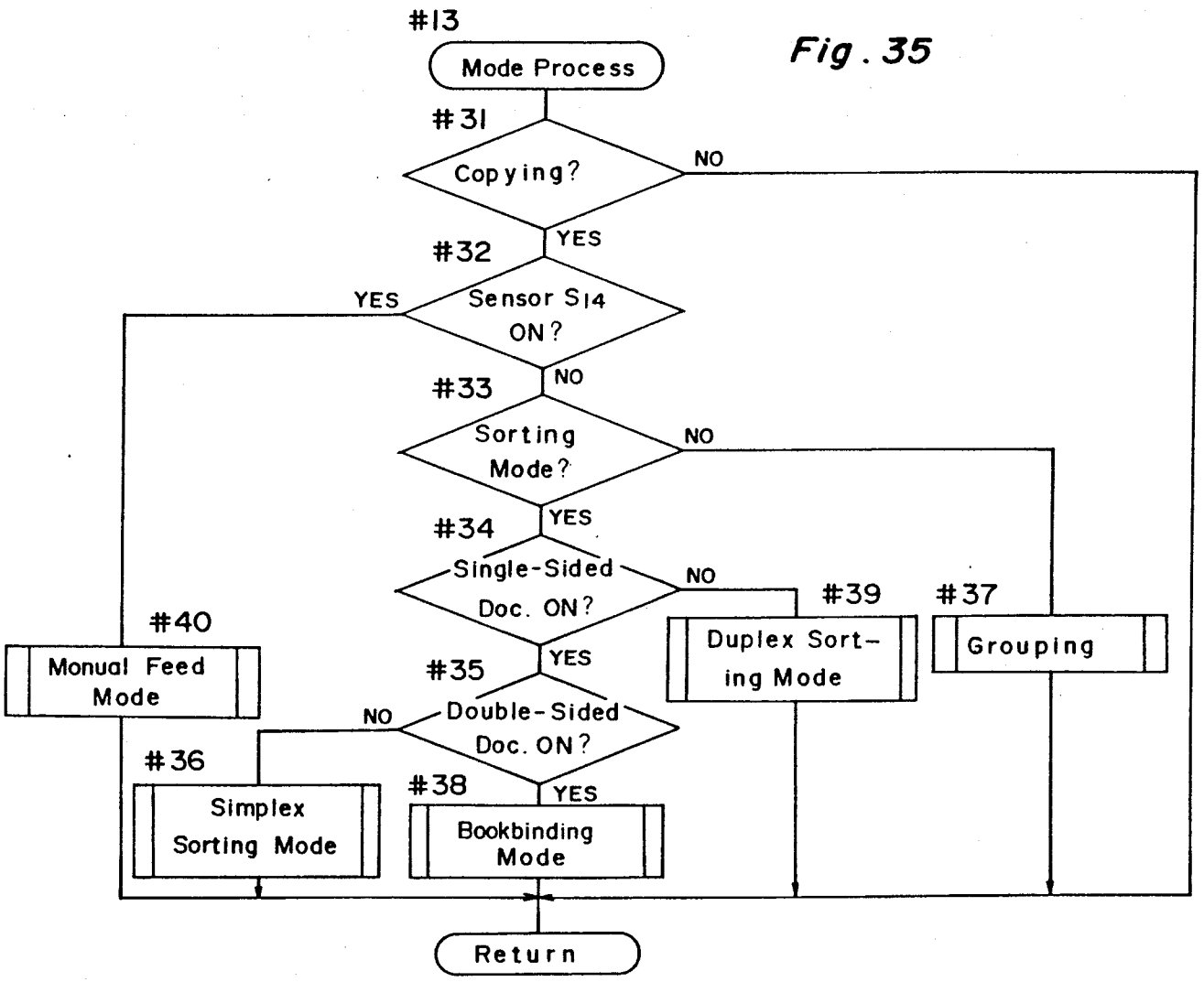
FIG. 35 is a flowchart showing the details of a mode processing subroutine shown in FIG. 34.

On the other hand, in the RDH block A, the main routine shown in FIG. 34 is executed under the control of the second central processing unit 252. Thereby, a mode processing based on a mode processing subroutine shown in FIG. 35 is executed and, if a manual feed detecting sensor $S_{14}$ is not switched on even though the copying takes place, the sorting mode is set by the mode changeover key 206 and the sorting mode is selected because, even though the documents OD are single-sided, they are not copied to provide duplex copies. (See steps #31 to #36.)

Figure 36:
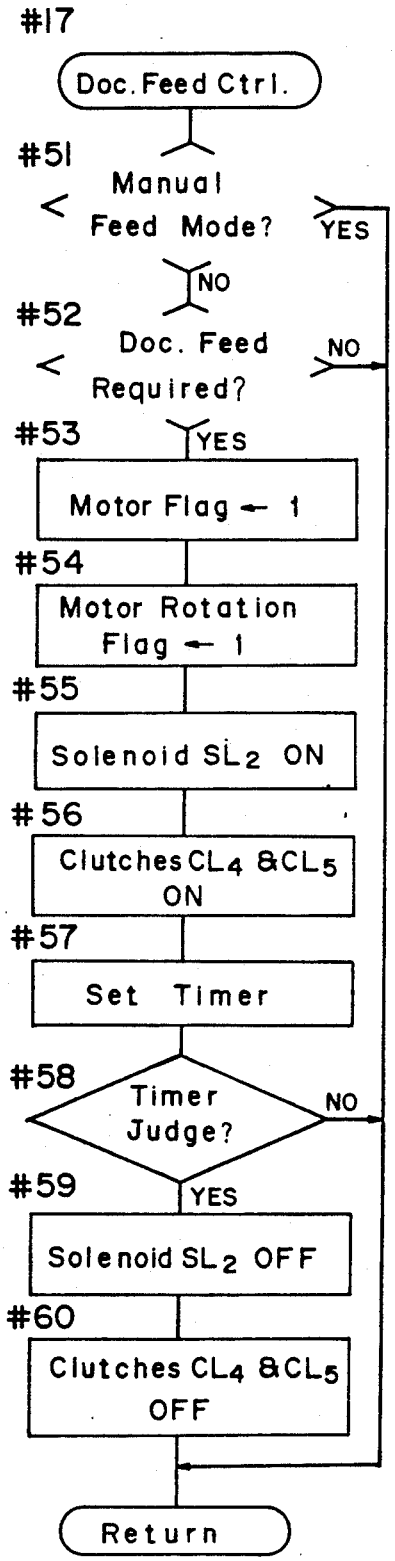
FIG. 36 is a flowchart showing the details of a document feed control subroutine shown in FIG. 34.
Figure 37:
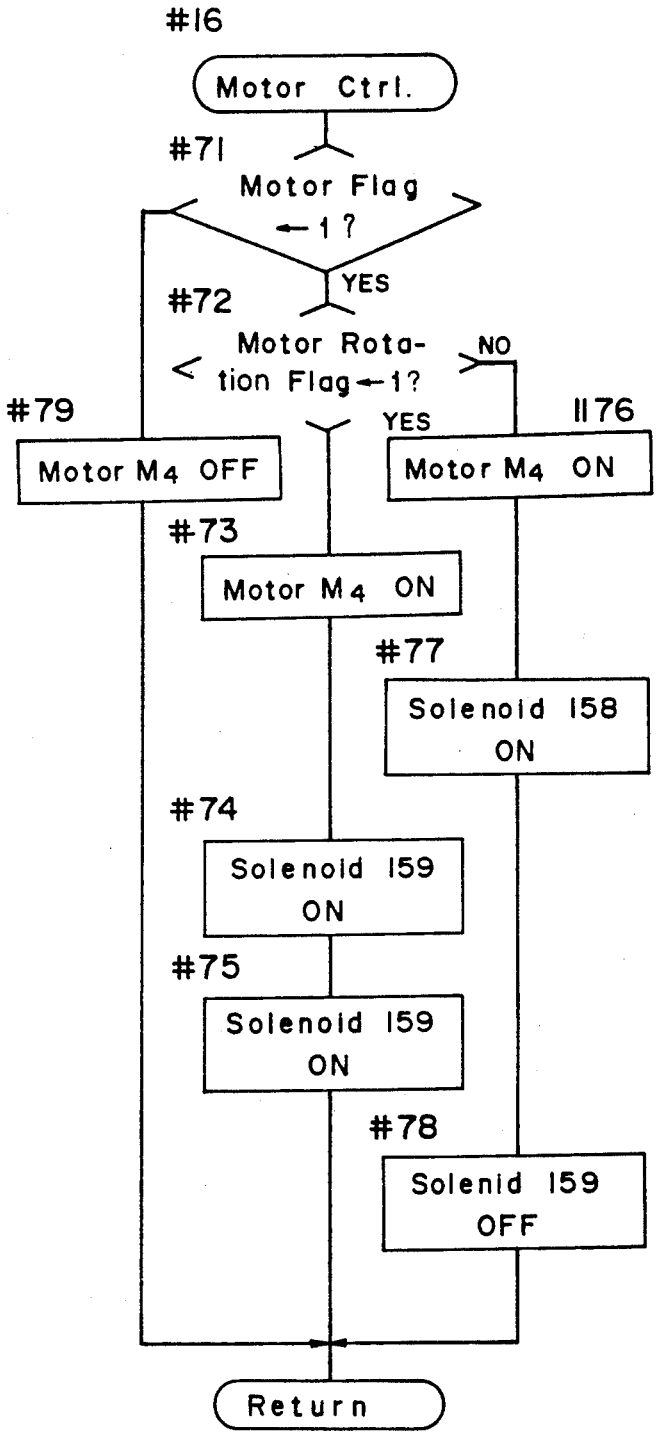
FIG. 37 is a flowchart showing the details of a motor control subroutine shown in FIG. 34.

Also, because the mode is not the manual feed mode, a document feed control subroutine shown in FIG. 36 is executed at step #51 and, after is has been confirmed that the second central processing unit 252 requires a document feed, a motor flag and a motor rotation flags are respectively set to 1 (See steps #52 to #54.) and a drive motor $M_4$ is started according to a motor control subroutine shown in FIG. 37 to drive a transmission system in a positive direction (See steps #71 to #75.).

Thereafter, the solenoid unit $SL_2$ is switched on to lower the document retainer 66 confronting the feed roller 76 at step #55 thereby to cause the feed roller 76 to be brought into contact with the stacked documents OD in the document support tray 71 and the clutches $CL_4$ and $CL_5$ for the feed roller 76 and the shuffling roller 77, respectively, are switched on at step #56 to allow respective drives to be transmitted to the feed roller 76 and the shuffling roller 77 through spring clutches (not shown) so that the lowermost document OD within the document support tray 71 can be drawn by the feed roller 76 towards the feed passage 73 through the shuffling roller 77. While the lowermost document OD so drawn outwardly from the document support tray 71 is transported through the feed passage 73 towards the delivery roller 79 via a sensor $S_{11}$, a timer to which a feed time necessary for the document OD to be exactly nipped through the delivery roller 79 is set is operated and, after the passage of the feed time set in the timer, the solenoid unit $SL_2$ is switched off to retract the document retainer 66 upwardly while the clutches $CL_4$ and $CL_5$ are switched off to interrupt the transmission of the drives to the feed roller 76 and the shuffling roller 77. (See steps #57 to #60.) Thereafter, the feed roller 76 and the shuffling roller 77 rotate in contact with the document OD being fed by the delivery roller 76. However, a load imposed on each of the feed roller 76 and the shuffling roller 77 is small because of the action of the spring clutch.

Figure 38:
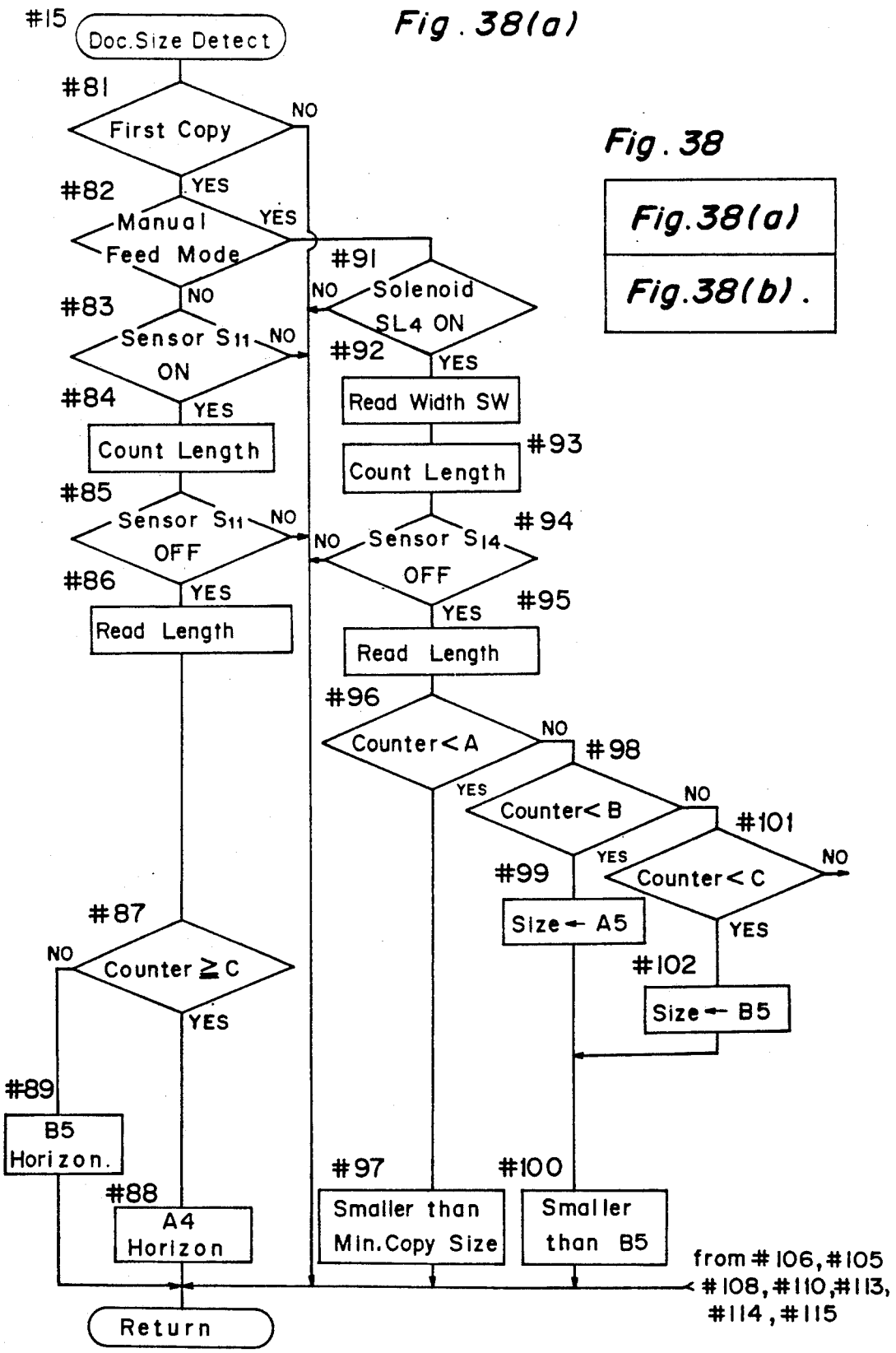
FIG. 38, comprised of FIGS. 38(*a*) and 38(*b*), is a flowchart showing the details of a subroutine shown in FIG. 34 for the detection of the size of the document.
Figure 38B:
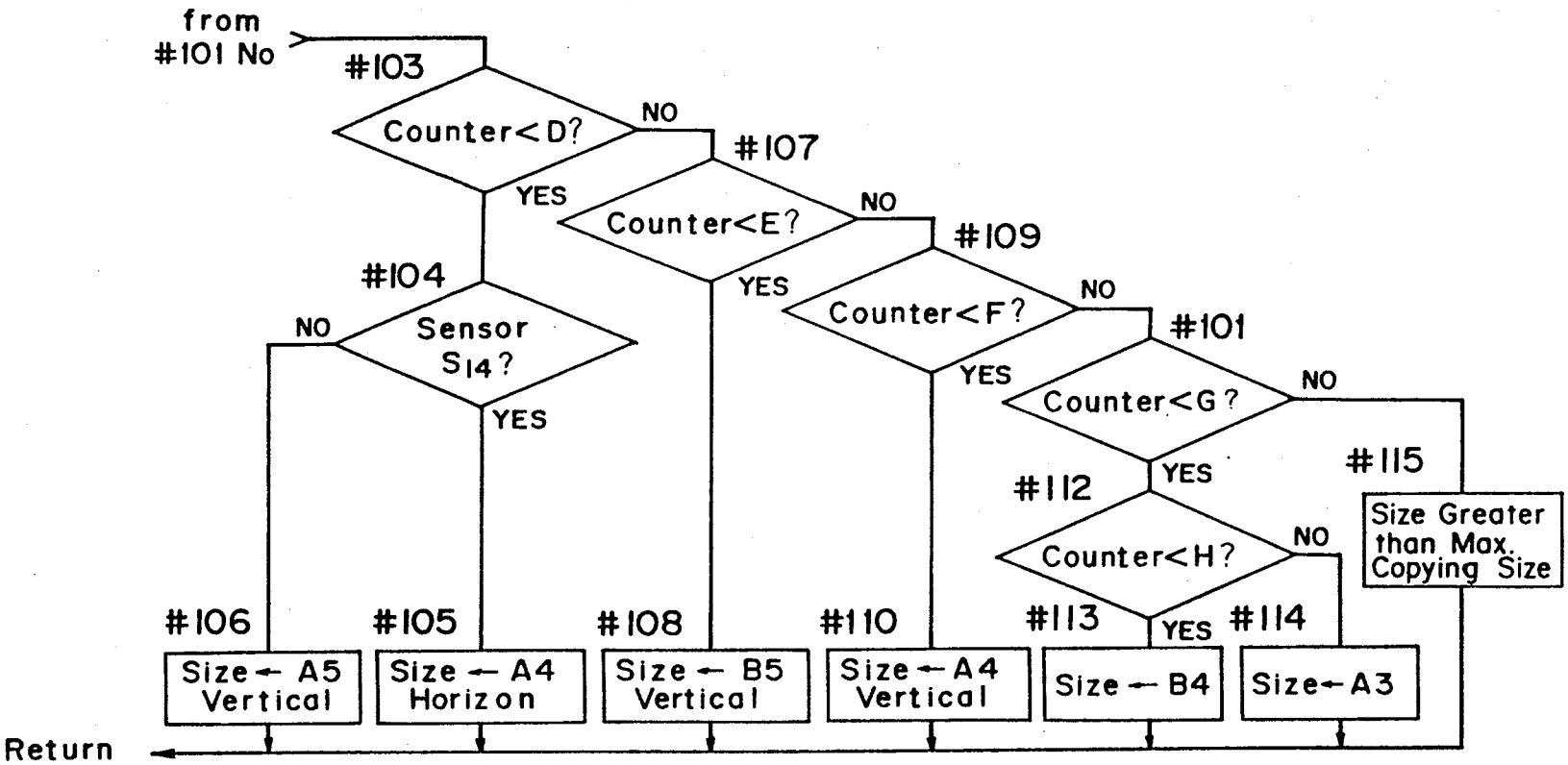

The size of the document is determined in terms of the length of the document OD by counting the time elasped during the passage of the document OD through a sensor $S_{11}$ according to a size detecting subroutine shown in FIG. 38. See steps #81 to #89. According to the size detecting subroutine shown in FIG. 38, if the documents OD accommodated within the document support tray 71 are of B5 or A4 size and placed in a horizontal position, the documents OD will be determined as being of A4 size and placed in the horizontal position if the count of the counter is greater than a predetermined value C (See steps #87 and #88), but if it is smaller than the predetermined value C, the documents OD are determined as being of B5 size and placed in the horizontal position (See steps #87 and #89).

Figures 39, 39A, 39B:
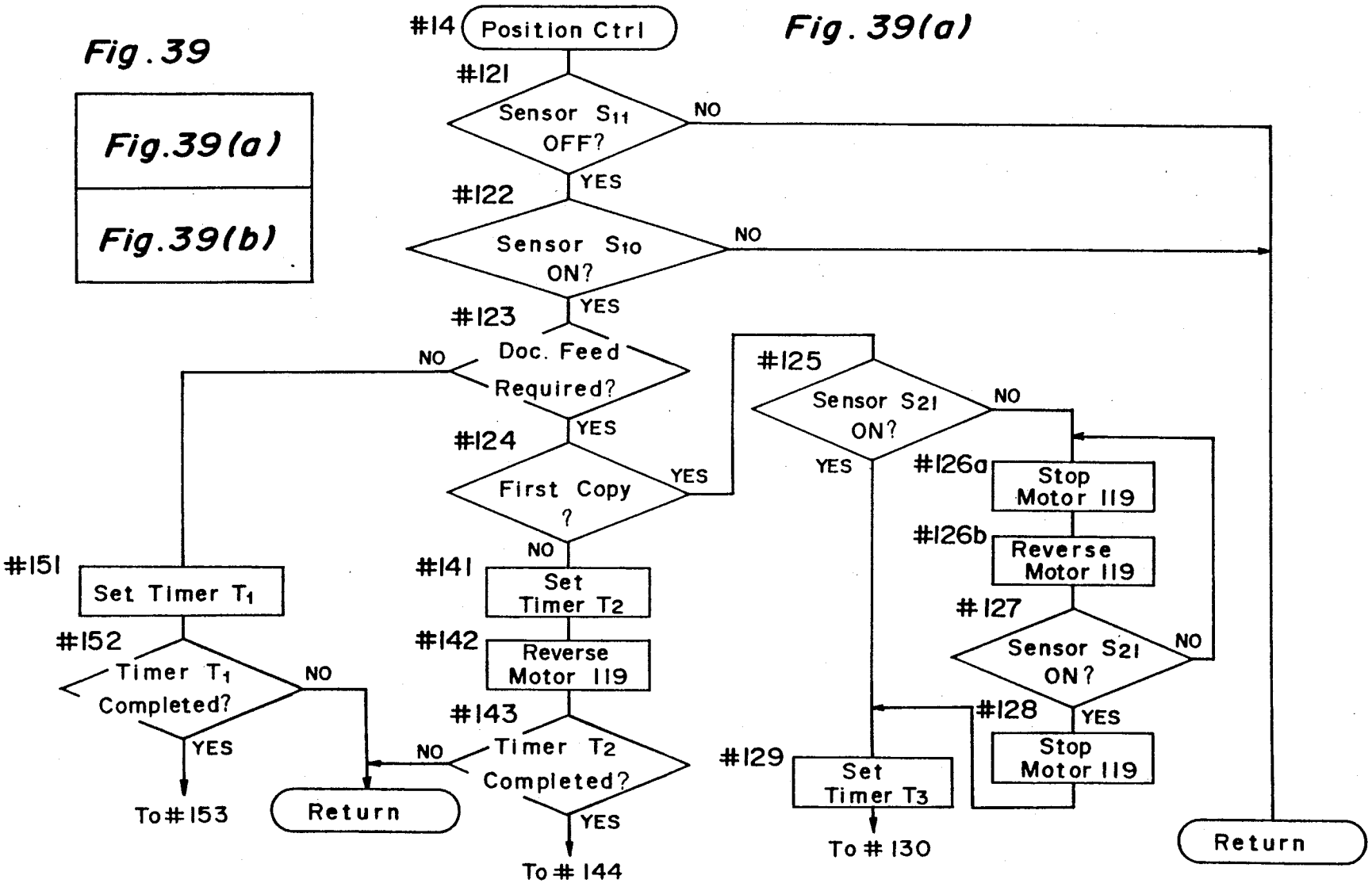
FIG. 39, comprised of FIGS. 39(*a*) and 39(*b*), is a flowchart showing the details of a position control subroutine shown in FIG. 34.
Figure 39B:
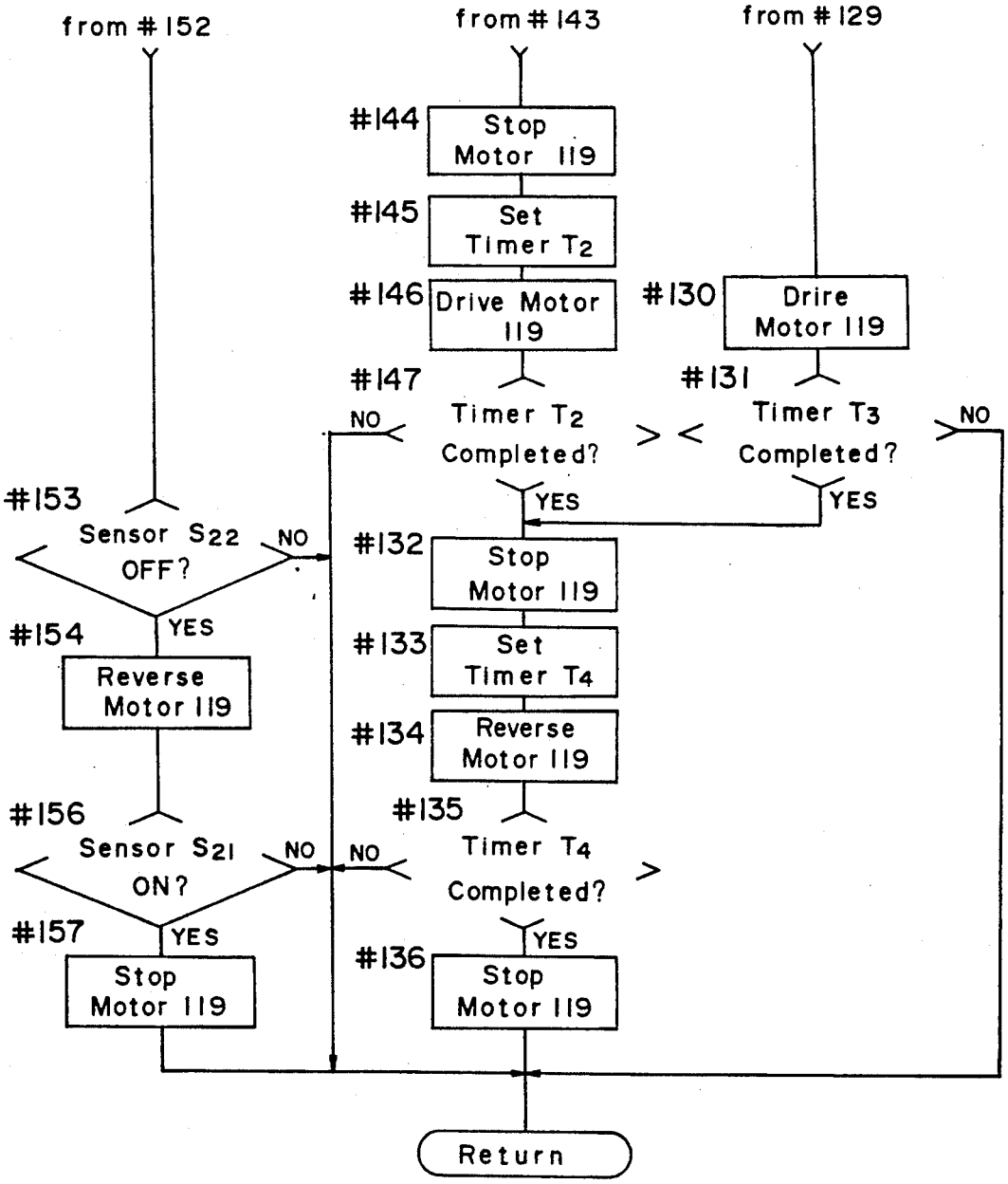

After the document size detection as described above, that is, after the trailing edge of the document OD has moved away from the sensor $S_{11}$ with the latter consequently switched off, a position control subroutine shown in FIG. 39 is executed. During the execution of the position control subroutine shown in FIG. 39, whether or not the document size detection has been made to a first copy is determined by conditions in which the sensor $S_{11}$ is switched off and a sensor $S_{10}$ is in position ready to detect the last document, that is, switched on, and the document feed is required (See steps #121 to #124), and, if it is deemed as the first copy, the positioning member 111 is moved from the home position a predetermined distance corresponding to the size of the document to cause the stacked documents OD within the document support tray 71 to be urged against the shuffling roller 77 (See steps #129 to #131). This is for the purpose of for forcibly urging the stacked documents OD against the shuffling roller 77 by means of the positioning member 111, thereby to substantially eliminate the problem which would occur as a result that arrangement has been made to ensure that the stack of the documents OD has been properly set on the document support tray 71 with the leading edges of the stacked documents OD brought into contact with the stopper 75 positioned preceding the shuffling roller 77 thereby to avoid any possible incorrect placement of the stacked documents OD in the document support tray, that is, the problem in which, while the feed of the documents has to be fed in towards the shuffling roller 77 from a set position preceding the shuffling roller 77, the insufficient feed-in would result in an improper feed of the document.

The movement of the positioning member 111 for the purpose described above is carried out by controlling the length of time, during which a motor 119 is driven in a positive direction by a timer T3 to which a predetermined time is set in correspondence with the document size, thereby to regulate the amount of movement of the slider 118. (See steps #130 and #131.)

When the positioning member 111 pushes the document OD, the last document detecting lever 115 is positioned above the trailing edge of the document OD. After the positioning member 111 has moved the document OD a predetermined amount, and after the motor 119 has subsequently been brought to a temporary halt, is reversed to retract the slider 118 a distance corresponding to the amount of play between the positioning member 111 and the window 113*a* (See steps #132 to #136). In this way, the last document detecting lever 115 is released from a pushing force applied by the slider 118 and rides onto the trailing edge of the documents OD on the document support tray 71 before the first document OD, the size of which has been detected, is returned, making it pssible to detect the last document. The amount of retraction of the slider 118 is carried out by controlling the length of time during which the motor 119 is reversed by a preset time of the timer $T_4$ (See steps #133 to #135).

It is to be noted that, where at the time of completion of the size detection of the first document OD the positioning member 111 is not at the home position and a sensor $S_{21}$ is therefore switched off, after the motor has been brought to a temporary halt and after the motor has subsequently been reversed to bring the positioning member 111 back to the home position, that is, after the positioning member 111 has been returned until the sensor $S_{21}$ is switched on, the positioning member 111 is moved to a predetermined position appropriate to the document size described above (See steps #125 to #128). Acccordingly, regardless of the position of the positioning member 111, it can be moved to a position appropriate to the size of the document.

On the other hand, the switching pawl 96 disposed at the U-shaped path 73*a* in the feed passage 73 remains at such a position as shown by the solid line in view of the fact that neither duplex copying nor manual feed is selected, and therefore, the first document OD fed into the upstream passage portion 73*d* of the feed passage 73 is guided by the switching pawl 96 into the U-shaped path 73*a* and then into the downstream passage portion 73*c*, subsequently arriving at the timing roller 81 through a sensor $S_{17}$ and then through a sensor $S_{18}$.

Figure 40:
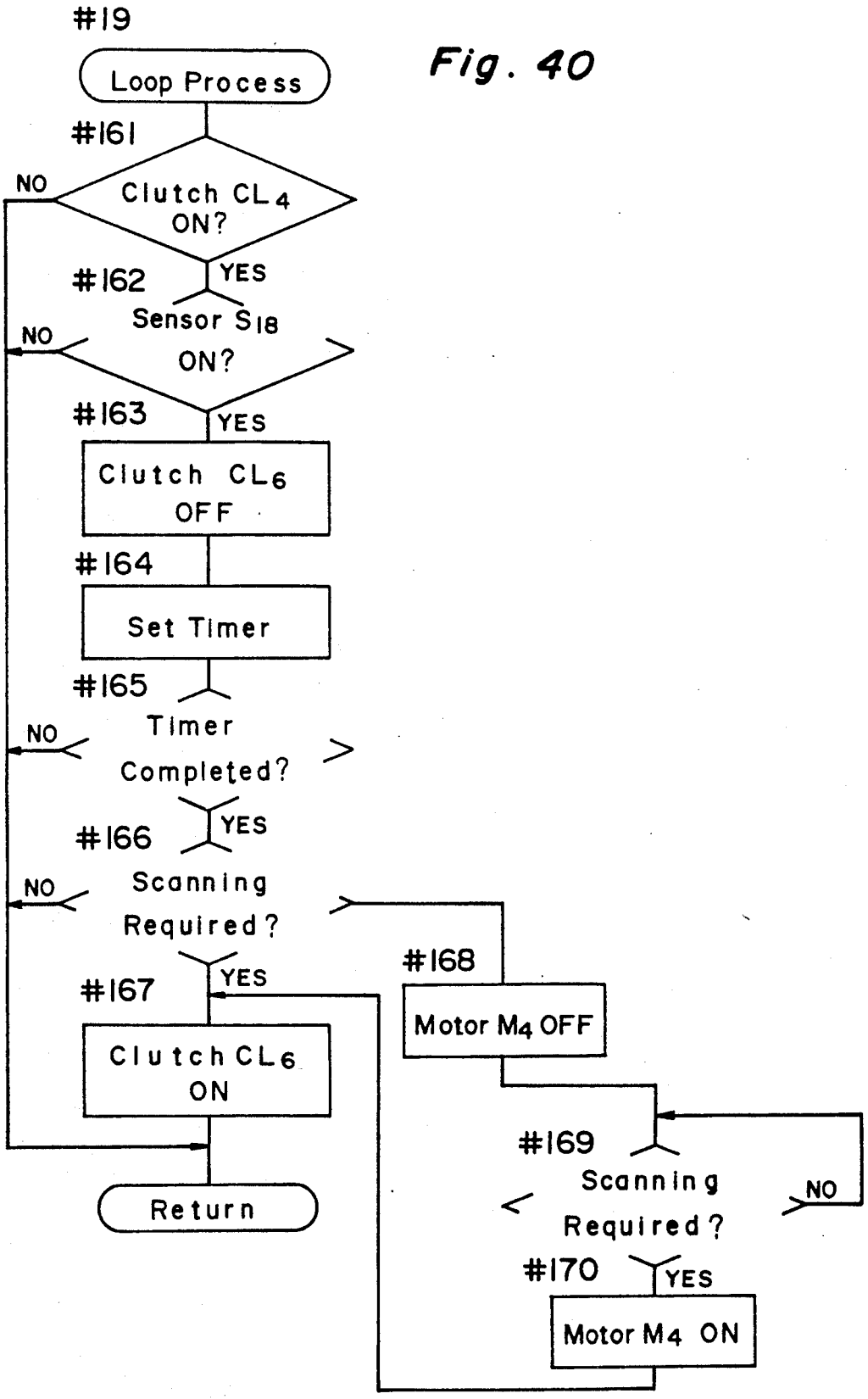
FIG. 40 is a flowchart showing the details of a loop processing subroutine shown in FIG. 34.

At this time, a loop processing is carried out according to a loop processing subroutine shown in FIG. 40. This loop processing subroutine is executed when the clutch $CL_4$ for the feed roller 76 is switched on at step #161 and the document OD subsequently switches the sensor $S_{18}$ preceding the timing roller 81 at step #162, so that the closure of the sensor $S_{18}$ can result in the opening of the clutch $CL_4$ and the opening of the clutch $CL_6$ for the timing roller 81 thereby to bring the timing roller to a temporary halt and, at the same time, a time to which a loop processing time is set is activated (See steps #163 and #164). Because of this, the document OD is fed by the delivery roller 80 to the timing roller 81 then brought to the temporary halt, so that the leading edge thereof can be registered to avoid any possible skewing while forming the loop. After the passage of the loop processing time set to the timer, and when a sensor S1 preceding the registration roller 27 is switched on in response to the passage therethrough of a recording paper in the copier block B, the clutch $CL_6$ is again switched on provided that a scanning request is issued from the first central processing unit 251. In this way, the timing roller 81 is restored to a drive condition to feed the document OD into the exposure guide passage 171 for the presentation thereof to the exposure.

Should no scan request be made at the time of completion of the timer for the loop processing, it means that the supply of the recording paper is not synchronized and, therefore, no proper copying will be made on the recording paper even though the document OD is presented to the exposure. Therefore, in such case, the motor $M_4$ is switched off without the timing roller 81 being driven again, thereby to avoid the possibility that the document OD may be further fed into the timing roller 81 then brought to the halt thereby to constitute a possible cause of wrinkling of the document OD and/or a possible jamming, allowing the document OD to stand still until any scan request be made (See steps #166, #168 and #169). Once the scan request is made, the motor $M_4$ is switched on and, at the same time, the clutch $CL_6$ for the timing roller 81 is switched on, thereby presenting the document OD to the exposure (See steps #169, #170 and #167).

The document OD presented to the exposure is subsequently fed into the circulating passage 74 and is returned to the document support tray 71, resting above the uppermost document in the stack of the documents OD within the document support tray 71 in a manner as shown in FIG. 6.

Figure 45:
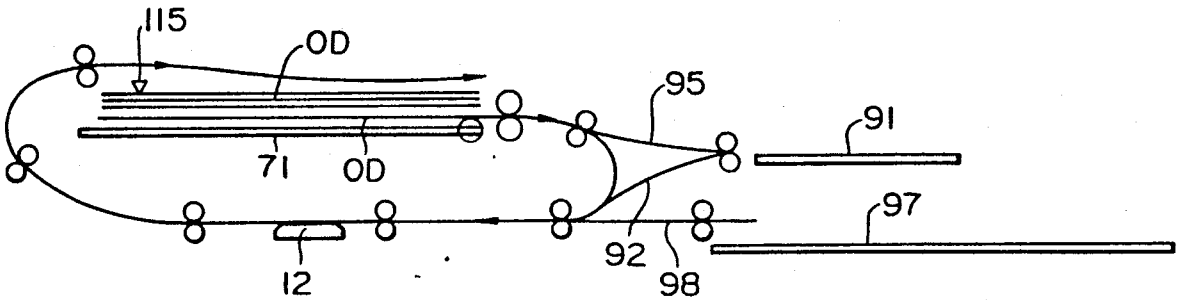
FIGS. 45 to 49 are schematic diagrams showing how a document is transported during each of various modes, respectively.

The movement of the document OD taking place at this time is as shown in FIG. 45 and the copying is sequentially carried out for each of the documents OD. On the other hand, the resultant copies are successively ejected through the discharge mouth 32 onto the copy receiving tray 44 by means of the discharge passage 41 according to the sorting mode process and, therefore, the copies on the copy receiving tray 44 are piled up in order of page.

Figure 41:
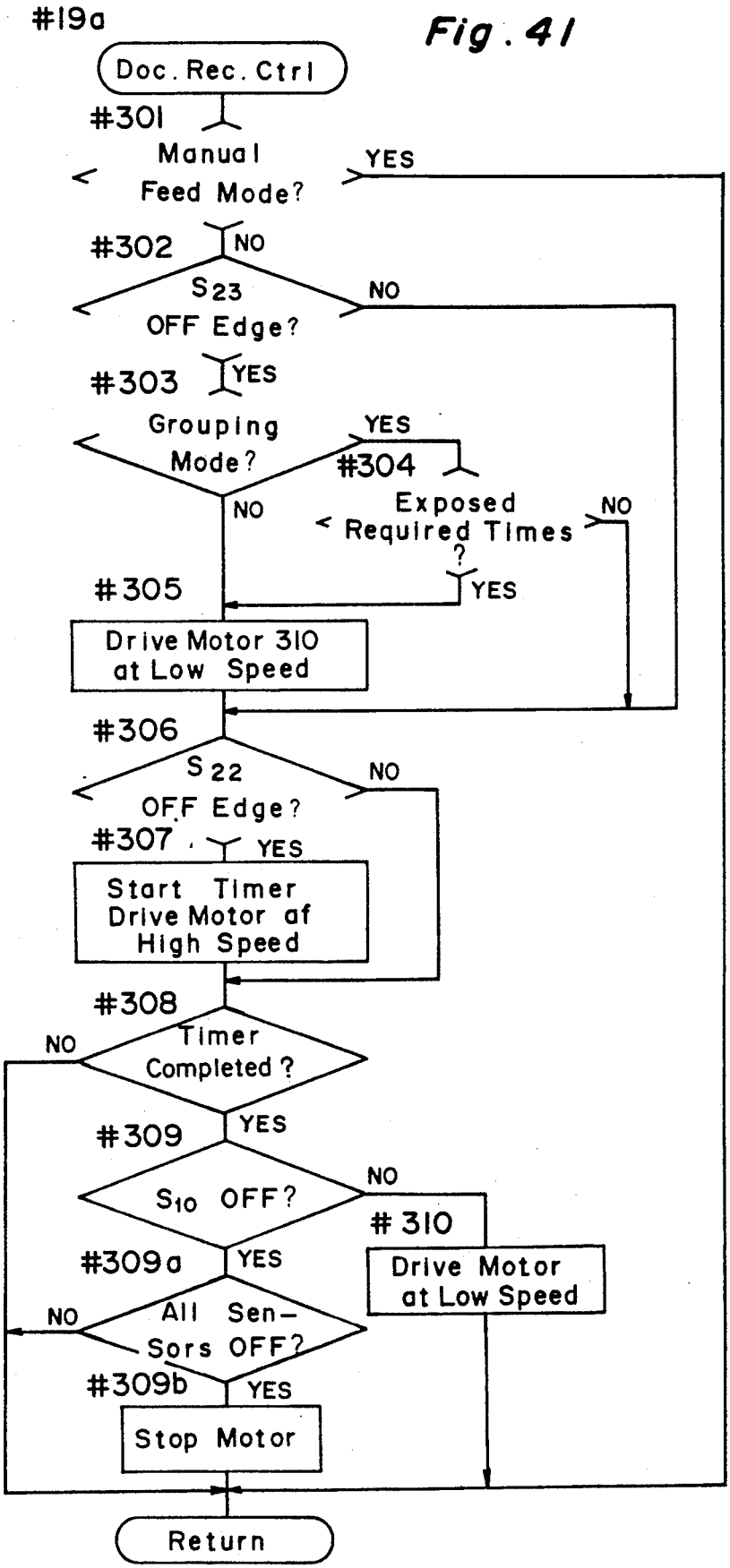
FIG. 41 is a flowchart showing the details of a document recovery control subroutine shown in FIG. 34.

In addition, in view of the fact that no manual feed mode is selected, a document recovery control subroutine shown in FIG. 41 is executed (See step #301), during which the document OD having been presented to the exposure is transported through the circulating passage 74 with its trailing edge detected by a sensor $S_{22}$ and, at the same time, where the grouping mode is not selected or where the exposure has been effected under the grouping mode through a number of times corresponding to the number inputted, that is, when a condition is established in which the document OD having been exposed is ready to be returned onto the document support tray 71 (See steps #302 to #304), the auxiliary roller 78 is driven by a motor 310 at a low speed at step #305. Then, when the trailing edge of the document OD is detected by the sensor $S_{22}$, a timer is set and, during a preset time, the auxiliary roller 78 is driven at a high speed. After the passage of the preset time, it resumes a low speed drive (See steps #306 to #310). In the event that the sensor $S_{22}$ detects the trailing edge of the next succeeding document OD, it is driven at a high speed for a predetermined time. During the circulation of the document OD, this is repeated to allow the documents OD to be successively fed at a high speed onto a predetermined position on the document support tray 71 so that the first-fed document OD can be primarily separated from the second-fed document OD. In this way, any possible intrusion of the second-fed document into between the first-fed document OD and the uppermost document remaining on the document support tray 71 can be avoided advantageously.

When the trailing of the last document OD is detected by the sensor $S_{22}$, the auxiliary roller 78 is driven at a high speed for a predetermined time as is the case with the other documents (See steps #306 to #408). Since a sensor $S_{10}$ has been switched off after the delivery of the last document OD, the auxiliary roller 78 then driven at the high speed is brought to a halt as a result that the absence of any document in the transport passage is confirmed by respective OFF statuses of sensors $S_{11}$, $S_{12}$, $S_{17}$, $S_{18}$, $S_{22}$ and $S_{23}$ (See steps #309 to **309*b*). It is to be noted that, when the documents OD are successively reciprocately transported for presentation to the exposure during the grouping mode or during the manual feed mode, the auxiliary roller 78** is not driven and is halted.

Figure 42:
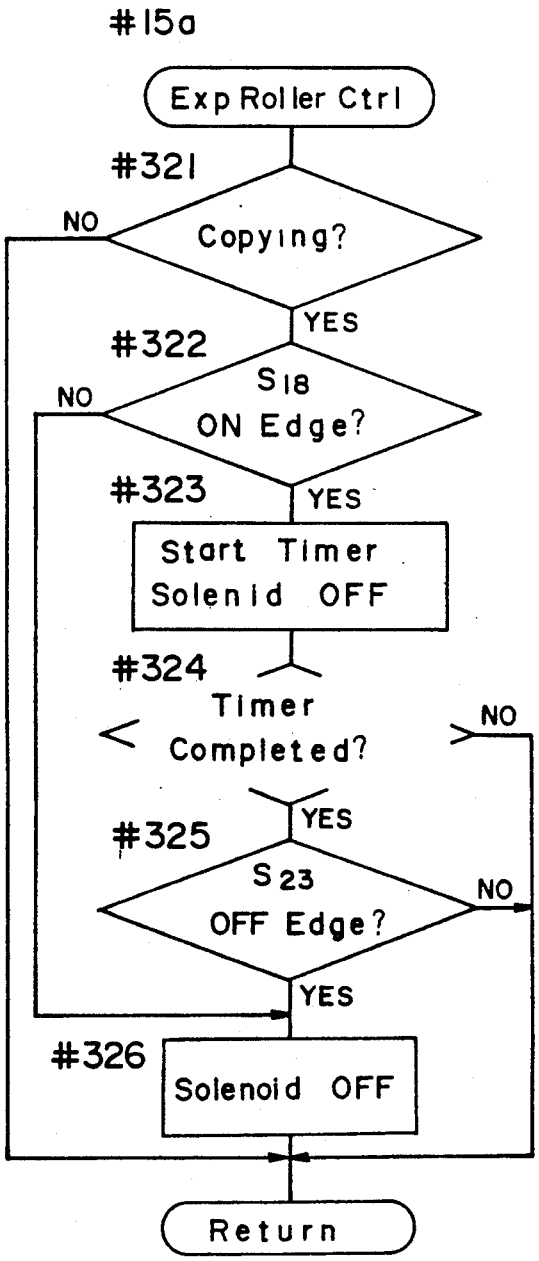
FIG. 42 is a flowchart showing the details of a press control subroutine shown in FIG. 34 for controlling the exposure roller.

Also, in view of the copying taking place, the exposure roller control subroutine (step #32) as shown in FIG. 42 is executed. During the execution of this exposure roller control subroutine, as shown in FIG. 42, a timer having a preset time set thereto is started upon the detection of the document OD by the sensor $S_{21}$ at the timing roller 81, and the solenoid unit 302 is then switched off (See steps #322 and #32). After the trailing edge of the document having been exposed has been detected depending on whether or not the sensor $S_{23}$ is on an OFF edge subsequent to the passage of the preset time at which the timer is terminated, the solenoid unit 302 is switched on (See steps #324 to #32). Up until the sensor $S_{18}$ detects the document OD, the solenoid unit 302 is kept in an ON state.

Thus, since each time the document OD is presented to the exposure, the solenoid unit 302 is switched off during a period after the arrival of such document OD at the timing roller 81 and before such document OD is returned onto the document support tray 71, the exposure roller 300 is urged against the glass platen 12 by the biasing force of the spring 307 to bring a successive portion of the document OD to be exposed while being transported above the glass platen 12 into contact with the glass platen 12. Accordingly, the document OD presented to the exposure can be kept in a focused condition thereby avoiding any possible reduction in quality of the reproduced image which would occur as a result of a defocused condition. The exposure roller 30 is then kept at an upwardly shifted position against the spring 307 when the solenoid unit 302 is switched on during a period in which the copying other than the above described copying is taking place, and therefore, the transportation of the document OD will not be adversely affected during any other occasion than the exposure with the document OD being transported in the reverse direction.

After the last document OD has been transported, the last document detecting lever 115 above the document support tray 71 undergoes such a movement as shown in FIG. 7 and, therefore, the transportation of the last document OD is detected by the sensor $S_{10}$. When this detection occurs, and since the second central processing unit 252 continues to issue a document feed request in view of the plural copies being made during the execution of the position control subroutine of FIG. 39 and it is not the first copy, a timer $T_2$ is activated in which a predetermined time required for the positioning member 111 to be retracted to a position at which it is sufficiently escaped from the document OD returned to the document support tray 71 and having the last document detecting lever 115 resting thereon has been set, followed by a reverse rotation of the motor 119 up until the timer $T_2$ is terminated, after which the motor 119 is brought to a halt (See steps #124 and #141 to #144). Accordingly, the last document detecting lever 115 is sufficiently disengaged from the document OD allowing the document OD to fall completely onto the document detecting lever 115.

Then, the motor 119 is driven in the positive direction for the preset time of the timer $T_2$, followed by a stop to return the positioning member 111 to the initial position while the document OD is fed to the shuffling roller 77 (See steps #145 to #147 and #132). At this time, the last document detecting lever 115 is upwardly shifted and assumes the upwardly shifted position at which it is clear from the documents OD on the document support tray 71. However, when a motor flag is rendered to be zero (0) to stop the motor 119 after the latter has been reversed for a predetermined time set in a timer $T_4$, the last document detecting lever 115 rests on the document OD and is ready to detect the last document remaining in the document support tray 71 (See steps #133 to #136).

In this condition, each of the documents OD is again copied in the manner as hereinbefore described. The copies formed on this occasion are ejected onto the copy receiving tray 44 so as to rest above a set of the copies previously made in a sorted fashion.

Such a copying is repeated a required number of times set in the machine and, after the completion of the last set of the copies, the second central processing unit 252 ceases its generation of the document feed request. After the termination of the document feed request has been determined (at step #123), the positioning member 111 is returned to the home position. In practice, this takes place after the last document detecting lever 115 has detected the last document and then activated a delay timer $T_1$ (at step #151). This delay timer $T_1$ is operable to delay the return of the positioning member 111 to the home position up until the last document OD is supplied and is then returned to the document support tray 71 after the exposure, that is, up until the documents OD assume the initial state. After the termination of the timer $T_1$, a decision is made to determine if the sensor $S_{22}$ for the detection of the complete return of the document onto the document support tray 71 is switched off, and if the sensor $S_{22}$ is switched off, the motor 119 is reversed to return the positioning member 11 to the home position at which the sensor $S_{11}$ is switched on, rendering the motor flag to be zero with the motor 119 consequently brought to a halt (See steps #152 to #153).

The feed request for each of the plural documents will pose a problem particularly during the first copying if in the copier block B they are successively supplied after the trailing edge of the previous document OD has passed through the sensor $S_{11}$ or after the passage of the predetermined time. Specifically, when during the first copying a single copy is desired to be made for each of the plural documents, the number of the documents fed during the first copying is unknown unless an operator of the copying machine inputs i, and, therefore, if the copying of a required number of copies equal to the number of the documents is completed while, even though the last document has been recirculated, the recording paper is supplied to the registration roller 27 at a predetermined timing and is then retained at the registration roller 27, the supply of an extra recording paper will result in an occurrence of a jammed condition. In view of the foregoing, according to the illustrated embodiment of the present invention, the successive supply of the documents for the first copying is continued only when the arrival of the recording paper at the registration roller 27 is confirmed at the timing when the trailing edge of each of the documents has been detected by the sensor $S_{11}$, and the subsequent supply of the recording paper is effected only when the presence of the document on the document support tray 71 has been detected by a sensor $S_{20}$.

During the subsequent copying of the documents, since the supply of the last document can be determined by counting the number of the documents during the previous recirculation of the documents from the document support tray 71 back to the document support tray 71, the recording papers are successively supplied in a number equal to the number of the documents at predetermined intervals subsequent to the timing at which the trailing edge of the document for the subsequent copying has been detected by the sensor $S_{11}$.

With respect to the ejection of the recording papers having the images copied thereon, that is, the copies, where the grouping mode is selected for each of the one-sided documents, it can be determined by a mode processing subroutine shown in FIG. 35 (See steps #33 to #36). Although the control of the supply of the documents OD under the grouping mode is not shown in any flowchart, it is carried out in such a manner that, each time the copying has been completed to provide the predetermined number of the copies of the documents OD supplied, the next succeeding documents OD are supplied.

Figure 46:
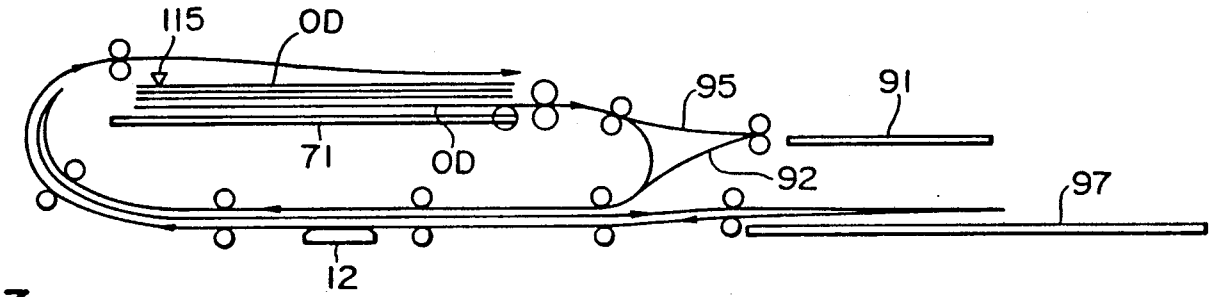

Each of the documents OD supplied are transported in the reverse direction each time the exposure is made until the exposure of a number of copies desired to be made is completed and, after it has been returned to a predetermined position past the sensor 18 preceding the timing roller 81 by the utilization of the discharge passage 98 and the document receiving tray 97, it is again presented to the exposure. The movement of each of the documents OD at this time is such as shown in FIG. 46.

It is to be noted that the stroke of reciprocal movement of each document at this time is determined in dependence on a size signal indicative of the size of each document and is selected to be of a minimum necessary stroke corresponding to each document of each size.

In correspondence with each exposure during the previous cycle, the supply of the recording papers and the image formation take place in the copier block B in a manner similar to those described above.

In the manner as described so far, each document OD is continuously presented to the copying operation to form the required number of copies and, thereafter, the recording papers one for each of the documents OD are successively discharged onto the copy receiving tray 44 so as to group with the previous set of copies identical with those currently discharged. By repeating those cycles, the sets of the copies can be grouped on the copy receiving tray 44.

Where a duplex copying of each of single-sided-documents is selected, it is determined as a bookbinding mode according to the mode processing subroutine of FIG. 35 (See steps #34, #35 and #36). Although a flowchart of this mode is not illustrated, and although the documents OD can be successively returned to the document support tray 71 while remain supplied to the exposure station in a manner similar to that described above, the supply of the recording papers and the image formation are controlled in the copier block B so that every other document the copying can take place for each of the documents and, at the same time, the recording paper having received a first copying is introduced into the intermediate tray assembly E for a moment.

When the copying of every other document OD is completed, the documents returned to the document support tray 71 are successively supplied to the exposure station again in the manner similar to that shown in FIG. 45 and are subsequently returned to the document support tray 71. At this time, in the copier block B, the recording paper each having one side copied with image, which are accommodated within the intermediate tray assembly E, are successively delivered in the order from the first-copied recording paper and, then, every other document which has not yet been copied is copied on the opposite blank side of each of the first-copied recording paper, followed by the discharge of the duplexed copies onto the copy receiving tray 44.

Thus, the images on each of the documents OD can be properly copied on the opposite sides of each of the recording papers that are sequentially discharged onto the copy receiving tray 44 in order of sequence of successive supply of the documents OD. In other words, the duplex copying can be accomplished in order of page and they can be presented for the bookbinding.

The stack of the documents OD is placed face up in the document support tray 71 and, in the order from the last page of the document, the documents can be sequentially presented to the exposure. Accordingly, where the number of the documents OD to be copied is odd, the image on the first page of the document which is last copied on a second page face of the last recording paper while a first page face of the last recording paper is left blank and, therefore, the blank first page face of the last recording paper can be advantageously used as a cover face.

Figure 43:
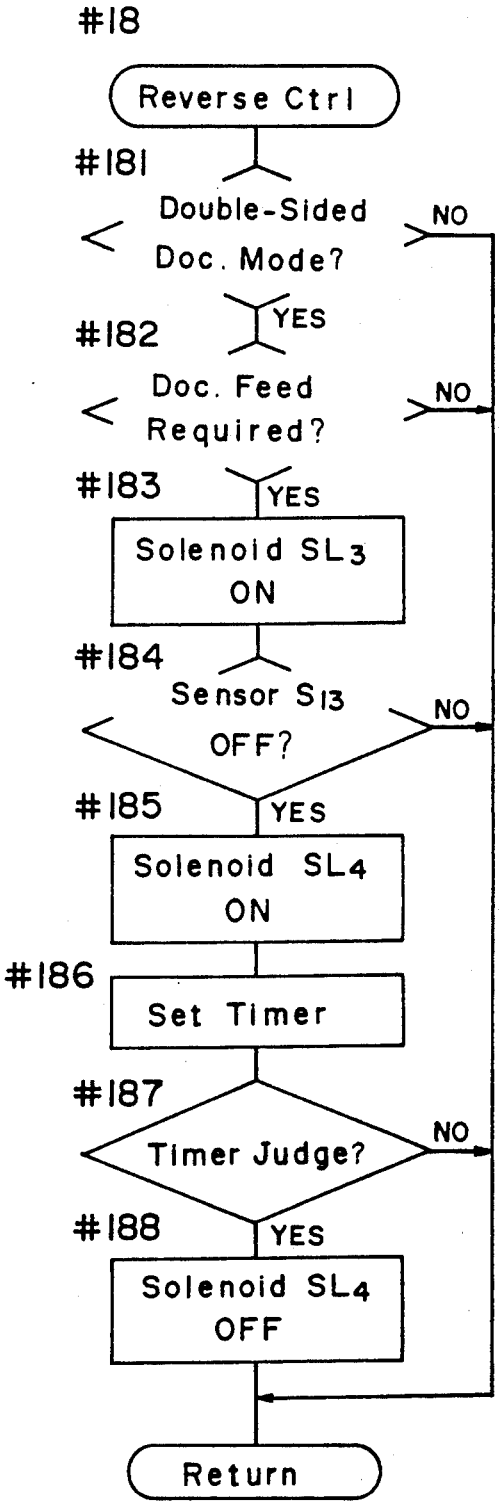
FIG. 43 is a flowchart showing the details of a subroutine shown in FIG. 43 for the reversion of a duplex-copied document.

On the other hand, if the number of the documents OD to be copied is even, an image of the document can be copied also on a first page face of the last recording paper.

Where a duplex copying of each of double-sided documents is selected, it is determined according to the mode processing subroutine of FIG. 18 (See steps #34 and #39). During this mode, each of the documents OD supplied from the document support tray receives a reverse control according to a double-sided document reverse control subroutine shown in FIG. 43 so that the respective document OD can be reversed upside down for the duplex copying. At the timing when the document feed request has been confirmed, the solenoid unit $SL_3$ for the switching pawl 96 is switched on to switch the switching pawl 96 over to a position shown by the phantom line in FIG. 1 (See steps #181 to#183). Once this has occurred, each of the documents OD successively supplied from the document support tray 71 is guided from the upstream passage portion 73*d* of the feed passage 73 towards the auxiliary passage 95 and, then, towards the manual feed tray 91 through the manual feed roller 94 normally rotated in a direction required to feed towards the manual feed tray 91.

When the sensor $S_{13}$ is switched off as a result of the passage of the trailing edge of the document OD, a switching solenoid unit $SL_4$ for a reverse drive is switched on to drive the manual feed roller 94 in the reverse direction (See steps #184 and #185). Thereby, the document OD is transported in a feed direction before it is discharged onto the manual feed tray 91, and, in view of the fact that by that time the trailing edge of the document OD has moved past the position of the switching pawl 96, it is guided towards the manual feed passage 92 and is then switched backwards so as to be presented to the exposure through the downstream passage portion 73*c* of the feed passage 73 and then through the exposure guide passage 171.

A timer is activated, after the reverse drive of the manual feed roller 94, to count the length of time sufficient to allow the backwardly switched document OD to be engaged in between the delivery roller 80 positioned downstream of the manual feed roller 94, and after the counting of the time, the switching solenoid unit $Sl_4$ is switched off to drive the manual feed roller 94 in the normal discharge direction required to discharge onto the manual feed tray 91 (See steps #186 to #188). This is for the purpose that, even when the supply of the next succeeding document OD is initiated while the document OD being switched backwards is still bitten by the manual feed roller 94, it can be sufficiently fed onto the manual feed tray 91 by the rotation of the manual feed roller 94 so that any possible waste of time resulting from the design wherein an early feed of the next succeeding document OD can be followed by the switchback of the document OD can be advantageously counterbalanced. In order to facilitate this smoothly, an upper roller of the manual feed roller 94 is used as a drive roller while an upper roller of the manual feed roller 94 is used as a driven roller.

Figure 47:
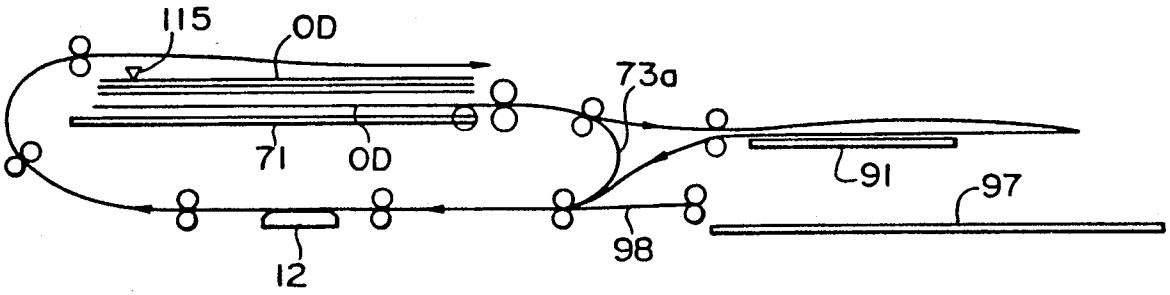

The document OD whose first side has been exposed is returned to the document support tray 71 in a manner similar to that effected in each of the previously discussed cases. The movement of the document OD taking place at this time is such as shown in FIG. 47 and the opposite second side of the document OD in the document support tray 71 can be presented to the exposure. Then, when the document OD is returned to the document support tray 71, the opposite second side thereof is oriented upwards in view of the fact that it has been passed through the U-shaped path 74*a* and then presented to the exposure.

In this way, the documents OD within the document support tray 71 are successively supplied with their second sides presented to the exposure to form respective copies and, after the exposure of the last document, the positioning member 111 acts in a manner similar to the completion of the recirculation of the documents shown in FIG. 45, in readiness for the subsequent copying of the second side of each of the documents OD.

The copying of the second side of each of the documents is accomplished subject to the respective document OD after the copying of the first side thereof has been made, in a manner similar to the case of FIG. 47. It is to be noted that, in the copier block B, the recording papers each having a first side onto which the image on the first side of each of the documents OD has been copied are successively accommodated into the intermediate tray assembly E temporarily and are sequentially presented for the copying on the second side thereof in the order from the first recording paper having the first side on which the image has been copied .

In this manner as hereinabove described, the duplex copying can be accomplished from each of the double-sided documents OD, and the duplexed copies so obtained can be discharged onto the copy receiving tray 44 in the order from the duplexed copy corresponding to the lowermost document in the document support tray 71 and also in order of page.

Where the number of copies desired to be made is plural, the previously described operation is repeated a number of times equal to the number of the copies desired to be made.

The case in which the document OD is manually supplied from the manual feed table 91 will now be described.

Figures 44, 44A, 44B:
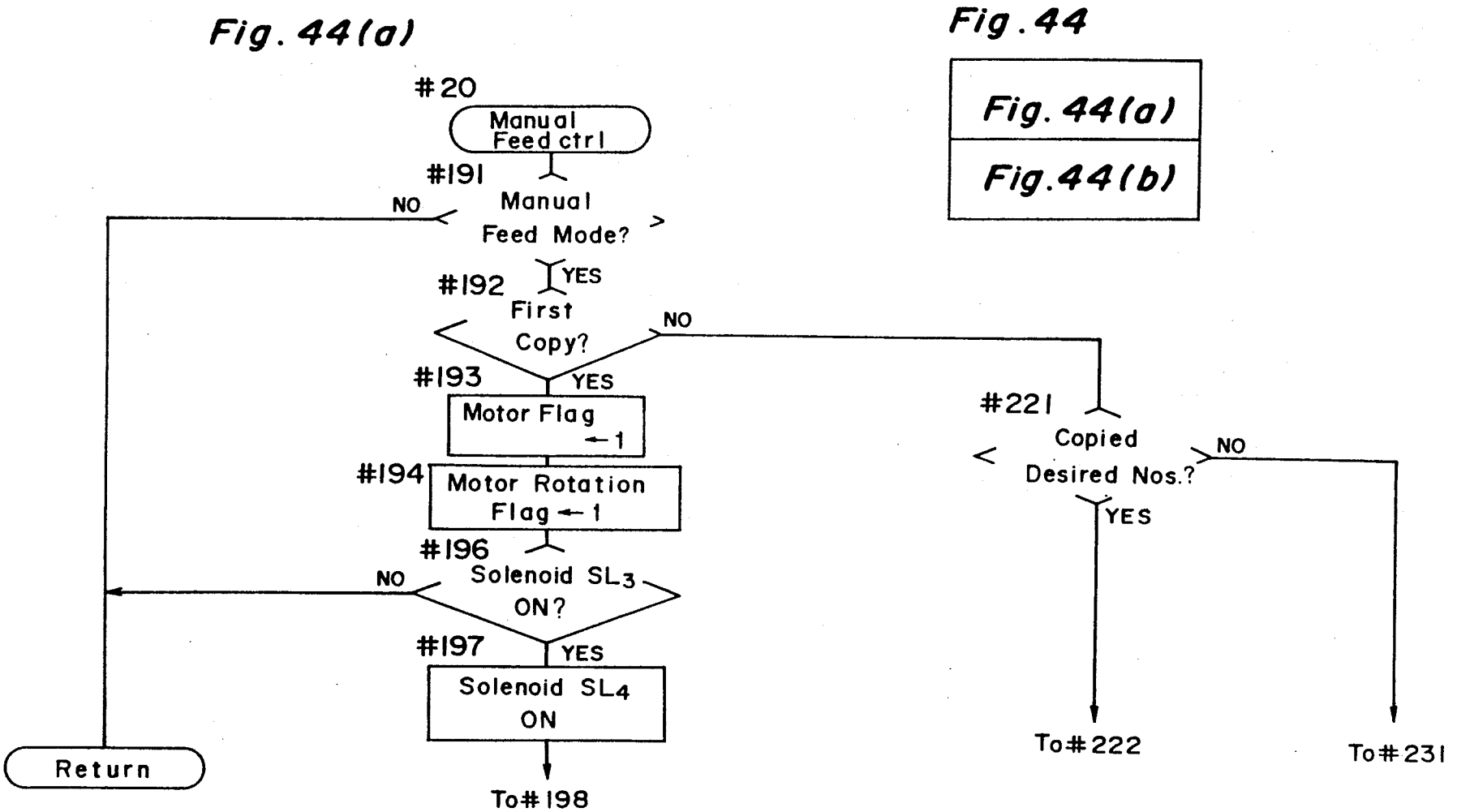
FIG. 44, comprised of FIGS. 44(*a*) and 44(*b*), is a flowchart showing the details of a manual feed control subroutine.
Figure 44B:
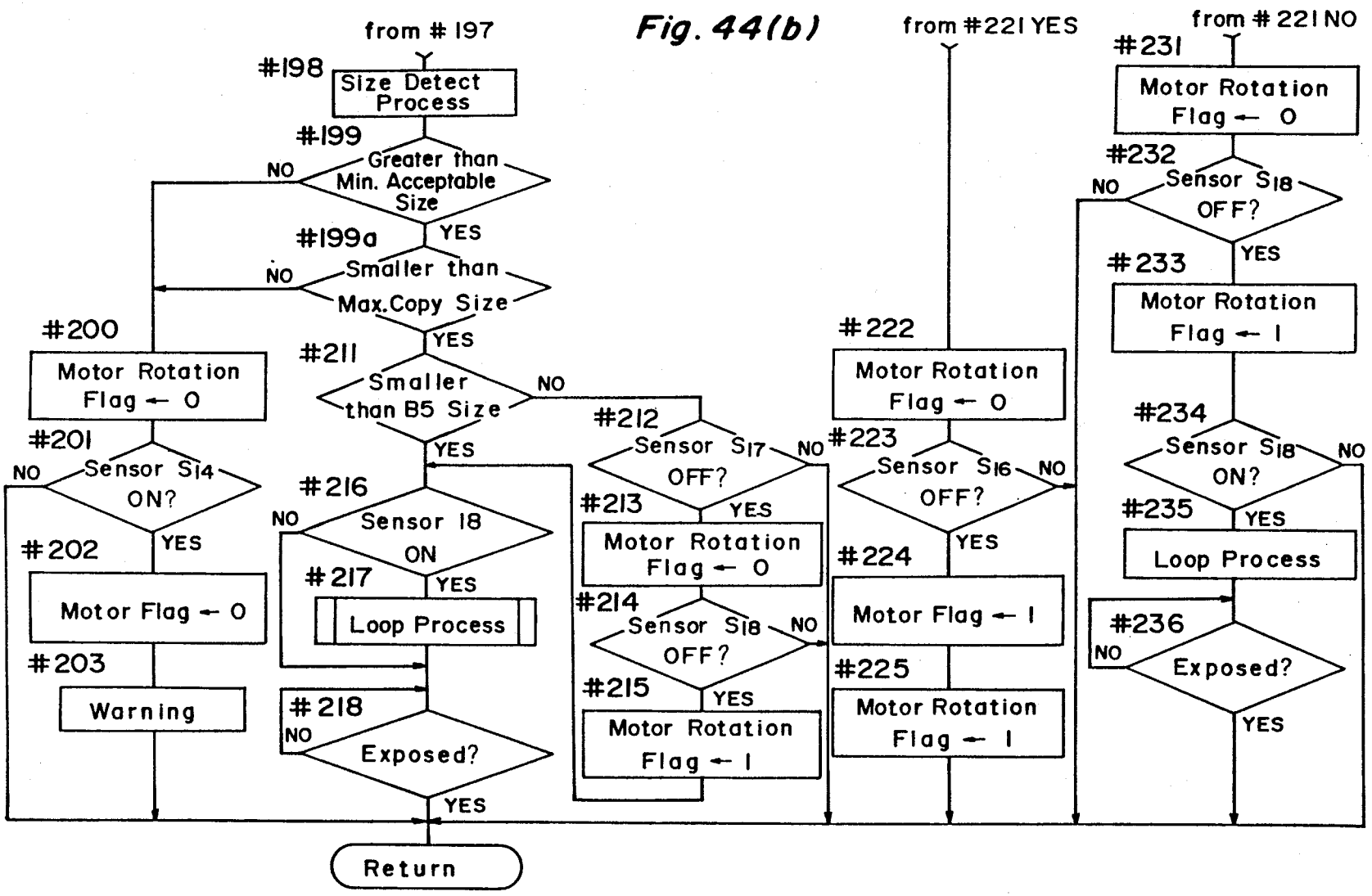

The document OD is bitten into the manual feed roller 94 while guided along the manual feed table 91. Since at this time a sensor $S_{14}$ preceding the manual feed roller 94 is switched on, it is determined as the manual feed mode according to the mode processing subroutine of FIG. 35 (See steps #32 and #40) and a manual feed control subroutine shown in FIG. 44 is executed accordingly.

In accordance with the determination that the manual feed control mode is executed, and during the first copying, a motor flag is rendered to be "1" and, then, a motor rotation flag is rendered to be "1" (See steps #191 to #194). Then, the motor $M_4$ is rotated and the transport system is normally rotated. Also, not only is the switching pawl 96 switched over to the position shown by the phantom line in FIG. 1 consequent upon the energization of the solenoid unit $SL_3$, but also the manual feed roller 94 is reversed to rotate by switching on the reverse drive switching solenoid unit $SL_4$ (See steps #196 and #197). Thereby, the manually fed document OD can be bitten by the manual feed roller 94 and is subsequently fed into the manual feed passage 92 guided by the switching pawl 96.

At this time, the length and the width of the manually fed document OD are detected by a sensor $S_{14}$ for counting the length of time required for the manually fed document OD to pass therethrough and a sensor $S_{13}$ positioned immediately following the manual feed roller 94, respectively, for the purpose of detecting the size of the manually fed document OD according to a document size detecting subroutine shown in FIG. 38 (See steps #91 to #115). While the detection of the size of the document OD is based on the detection of the length and the width of the document OD, it can be accomplished regardless of the manner in which the document OD of any size is manually fed in either horizontal or vertical position and, therefore, the system can have a relatively large freedom of accommodating documents of any size used. However, in the case of a small document, it may occur that the document of a size unable to accommodate may be manually fed by the operator who does not know of the limitation. Therefore, in the illustrated embodiment, should the document of any size including the size the copying system can accommodate, the transport system is reversed and the manual feed roller 94 is normally rotated to reverse the document towards the manual feed table 91 and, at the time when the manual feed sensor $S_{14}$ is switched off and the document is then completely delivered onto the manual feed tray 91, the motor $M_4$ is switched off to perform a warning process (See steps #200 to #300).

While the details of the warning process will not be described for the sake of brevity, it may include a visual display of a warning signal at the operating panel 201 and/or an energization of one or both of a warning lamp and a buzzer.

The exposure is effected if the manually fed document OD is of a size equal to or greater than a minimum acceptable size and equal to or smaller than a maximum acceptable size. However, if the document OD is greater than a B5 size, a problem would occur in which, when such document OD is presented to the exposure, it may be passed through the timing roller 81 then continuously driven, failing to accomplish the loop processing, and/or a portion of the document which is beyond the exposure station above the glass platen 12 may not be properly reproduced. In order to avoid those problems, where the document of such a size is manually fed, it is initially fed for the purpose of an idle feed process for the purpose of the size detection and, when the trailing edge of the document OD is detected as a result that a sensor $S_{17}$ positioned preceding the delivery roller 80 is switched from an ON state over to an OFF state, the motor rotation flag is rendered to be "0" reverse the transport system thereby delivering the document OD from the document discharge passage 98 temporarily onto the document discharge tray 97 (See steps #211 to #213). In this way, when the sensor $S_{18}$ positioned immediately preceding the timing roller 81 is switched off as a result of a separation of the document OD away from the sensor $S_{18}$, the motor rotation flag is rendered to be "1" to switch the transport system to a position in which it is rotated in the positive direction (See steps #214 and #215).

Therefore, the manually fed document OD whose size has been detected is again transported to the timing roller 81 through the sensor S18 and is, after having been subjected to the loop processing, presented to the exposure (See steps #216 and #217).

If the manually fed document OD capable of being copied is smaller than the B5 size, it has not yet been transported through the sensor $S_{18}$, immediately preceding the timing roller 81, at the time the size thereof had been detected, and therefore, since a loss of time will occur if such manually fed document OD is transported idle, no idle transportation is effected and, instead, such manually fed document OD is allowed to be normally transported for the loop processing and the subsequent presentation to the exposure (See steps #211, #216 and #217).

The completion of the exposure can be determined by counting the length of time subsequent to the passage of the trailing edge of the document OD past the sensor $S_{18}$ and prior to the sensor $S_{18}$ being switched off. Once the completion of the exposure has been determined (at step #218), and, if the determination of the first copying has been dissolved and the copying to provide copies equal in number to the number of copies desired has been terminated, a motor rotation flag is rendered to be zero with the transport system consequently reversed to discharge the document OD having been exposed to the document discharge tray 97 through the document discharge passage 98 (See steps #221 and #222). When the completion of this discharge has been confirmed by a sensor $S_{16}$ having been switched off, the motor flag is rendered to be zero with the motor $M_4$ consequently brought to a temporary halt and, thereafter, the motor rotation flag is rendered to be 1 with the transport system consequently driven in the positive direction, terminating the manual feed control (See steps #222 to #225).

If the copying to provide the copies equal in number to the number of copies desired has not yet been completed at the time the determination of the first copying is dissolved, the transport system is reversed to reverse feed the manually fed document OD until it deviates from the sensor $S_{18}$ immediately preceding the timing roller 81 and then switches if off, and, when the sensor $S_{18}$ is switched off, the motor rotation flag is set to "1" so that the transport system can resume the drive in the positive direction whereby the manually fed document OD can be subjected to the loop processing and subsequently to the exposure (See steps #221, #231 to #235). In other words, up until the copying is carried out to provide the copies equal in number to the number of copies desired, the manually fed document OD is reciprocally moved over the exposure station to accomplish it.

Figure 48:
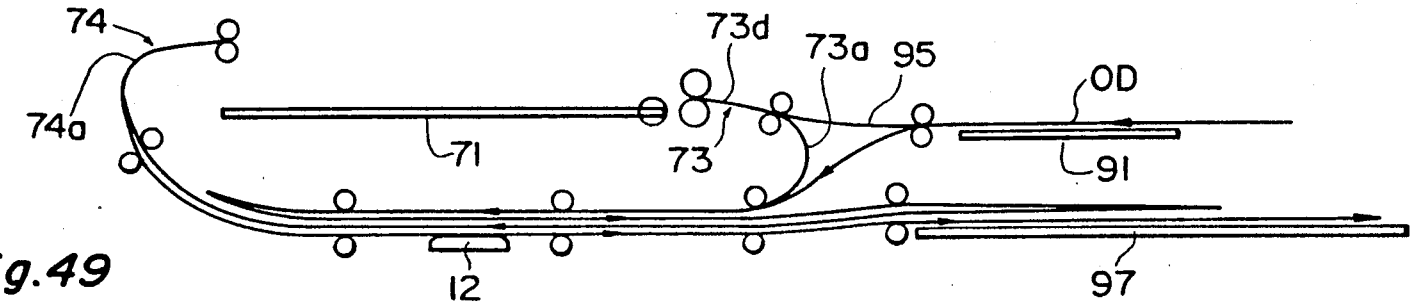
Figure 49:
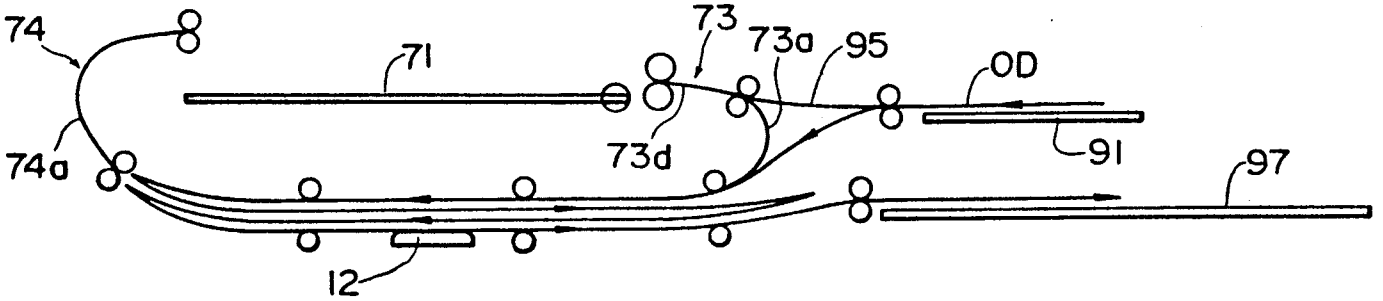

The movement of the manually fed document OD used to provide a single copy is such as shown in FIG. 48. On the other hand, the movement of the manually fed document OD used to provide a number of copies is such as shown in FIG. 49. It is to be noted that FIG. 48 illustrates the case in which the document OD is greater than the B5 size and is therefore subjected to the idle transport, whereas FIG. 49 illustrates the case in which the document OD is smaller than the B5 size and is therefore not subjected to the idle transport.

In the foregoing embodiment, the manually feed roller 94 is, during any one of the other modes than the manually feed mode, that is, during the period in which the sensor $S_{14}$ does not sense the presence of the manually fed document, normally driven in a direction required to discharge the document towards the manually fed table 91 so that, so long as no proper document is manually fed enough to activate the sensor $S_{14}$, foreign matter will not be bitten into the manual feed passage 95. It is, however, to be noted that similar effects can be appreciated even when the manual feed roller 94 is held still during any one of the modes other than the manual feed mode.

Also, for discharging the manually fed document and also for temporarily reverse feeding the document to the exposure station in an attempt to make a number of copies from the same document, the use has been made of the manual feed table 91, the document discharge tray parallel to the manual feed passage, and the manually fed document discharge passage. However, they may be get dispensed with and, instead, the manual feed passage and the manual feed table can be employed, making it possible to simplify the structure and the control of the copying machine embodying the present invention.

As an alternative to the foregoing illustrated embodiment, arrangement may be made that the auxiliary roller 78 such as employed in the foregoing embodiment need not be employed and separate drive systems may be employed one for each of a group of the delivery rollers 77, 79, 80 and 81 and a group of the delivery rollers 82 ,301, 82, 83 and 85. The copying machine as a whole according to this alternative embodiment may be controlled in a manner substantially similar to that described hereinbefore in connection with the foregoing embodiment, except that the document recovery control executed in the alternative embodiment differs from that in the foregoing embodiment. This difference will now be described with particular reference to FIG. 50.

Figure 50:
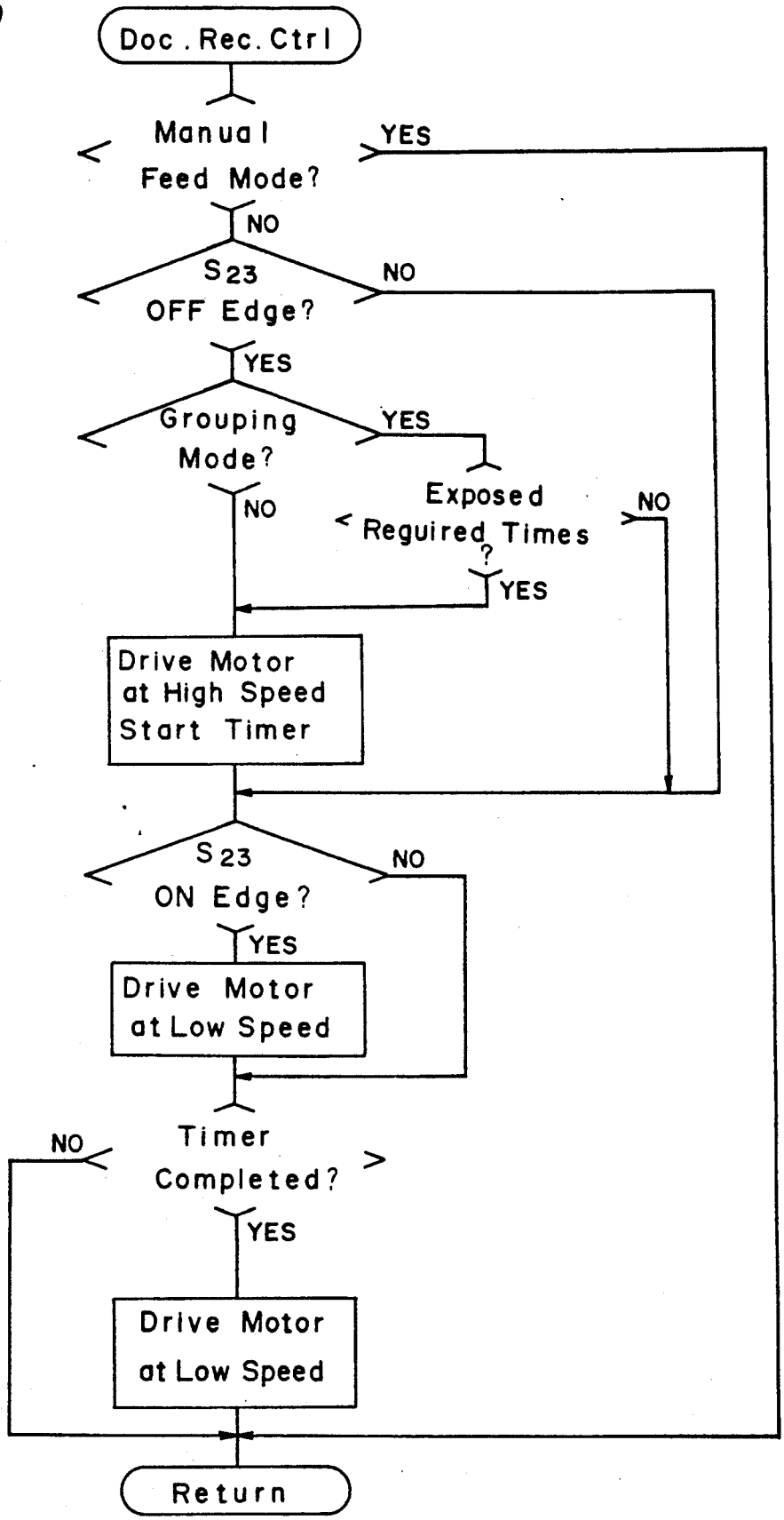
FIG. 50 is a flowchart similar to FIG. 41, showing a modified document recovery control subroutine.

During the execution of the modified document recovery subroutine shown in FIG. 50 which takes place if the mode is not the manual feed mode, when the document OD having been presented to the exposure to be transported back to the document support tray 71, the document OD is transported through the circulating passage 74 and, at the time the trailing edge of the document OD being circulated is detected by the sensor $S_{23}$, the transport speed of each of the rollers 82, 301, 82, 83 and the discharge roller 85 positioned downstream of the exposure station is switched over to a high speed mode and, at the same time, a timer is set. Should the document OD being circulated towards the document support tray 71 is not the last document, the rollers 82, 301, 82, 83 and 85 are driven at an initial low speed at the time the leading edge of the next succeeding document OD has been detected by the sensor $S_{23}$, but in the case of the last document, they are driven at the initial low speed when and after the previously set timer is terminated.

Even in this alternative embodiment, the high speed transportation of the document OD to be returned to the document support tray 71 allows the second-fed document to be separated from the first-fed document and, therefore, any possible intrusion of the second-fed document into between the first-fed document and the stack of the document OD remaining within the document support tray 71 can be advantageously avoided.

Furthermore, while the foregoing embodiment is directed to the application of the concept of the present invention to the copying machine of a type wherein the optical system is stationary and the documents to be copied are successively moved past the exposure station. However, the present invention can be equally applicable to the copying machine of another type wherein each of the documents is held still at the exposure station and the optical system is movable to scan the document stationary at the exposure station.

From the foregoing full description of the present invention, it is clear that, since when each document is returned to the document support tray the auxiliary roller is driven to feed the document being returned to the document feed unit, a presentation of the document returned to the document support tray can be assuredly again presented automatically to the exposure station.

In addition, since the auxiliary roller is switched over to a high speed drive for a predetermined time subsequent to the complete return of the document to the document support tray, the document so returned to the document support tray can be transported to the document feed unit during the predetermined time subsequent to the complete return of the document to the document support tray, allowing the next succeeding document to be separated a distance from the previously transported document, and therefore, even if the transport interval between the neighboring documents then transported may vary, the distance of separation between the neighboring documents can be maintained at a value equal to or greater than a predetermined interval thereby avoiding the possibility that the subsequently transported document may intrude into between the previously transported document and the stack of documents within the document support tray.

Although the present invention has fully been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. An apparatus for use in a copying machine having a platen for repeatedly recirculating a plurality of documents successively past the platen for making copies thereof, which apparatus comprises:

a document support member for supporting the plurality of documents;

a recirculating transport means including a document feed unit for transporting the documents one by one from the document support member towards the platen and a document discharge unit for transporting the documents from the platen to the document support member; and an alignment roller provided on the document support member for aligning each of the documents, which have been discharged from the document discharge unit towards the document feed unit;

wherein said alignment roller is driven at a speed higher than a speed of transportation by the recirculating transport means.

2. The apparatus as claimed in claim 1, wherein said recirculating transport means is operable to feed the documents in the order from a lowermost one of the documents in the document support member and then to return it onto an uppermost one of the documents in the document support member.

3. The apparatus as claimed in claim 1, wherein said alignment roller is a paddle.

4. An apparatus for use in a copying machine having a platen for repeatedly recirculating a plurality of documents successively past the platen for making copies thereof, which apparatus comprises:

a document support member for supporting the plurality of documents;

a recirculating transport means including a supply unit for transporting the documents one by one from the document support member towards the platen, a transport unit for moving the documents along the platen, and a delivery unit for returning the documents from the platen to the document support member;

an alignment roller provided on the document support member for feeding each of the documents, which have been returned from the delivery unit to the supply unit; and means for driving the alignment roller at a first speed when the documents are successively returned to the document support member and at a second speed for a predetermined time subsequent to the return of each of the documents, said first speed being equal to the transport speed of the delivery unit, and said second speed being higher than the first speed.

5. The apparatus as claimed in claim 4, wherein said supply unit successively feeds a lowermost of the documents, and said delivery unit returns the respective document onto the top of the documents in the document support member.

6. The apparatus as claimed in claim 5, further comprising means disposed at the delivery unit for detecting a passage of a trailing edge of the respective document with respect to the direction of movement thereof towards the document support member, and wherein said driving means is operable to switch from the first speed over to the second speed in response to an output from the detecting means.

* * * * *